US009598663B2

(12) United States Patent
Kita et al.

(10) Patent No.: US 9,598,663 B2
(45) Date of Patent: Mar. 21, 2017

(54) LIQUID DETERGENT COMPOSITION FOR CLOTHING

(71) Applicant: KAO CORPORATION, Tokyo (JP)

(72) Inventors: Ayako Kita, Wakayama (JP); Yuki Yanagisawa, Wakayama (JP); Masataka Maki, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 14/655,909

(22) PCT Filed: Dec. 25, 2013

(86) PCT No.: PCT/JP2013/084548

§ 371 (c)(1),
(2) Date: Jun. 26, 2015

(87) PCT Pub. No.: WO2014/104044

PCT Pub. Date: Jul. 3, 2014

(65) Prior Publication Data

US 2015/0337244 A1 Nov. 26, 2015

(30) Foreign Application Priority Data

| | | |
|---|---|---|
| Dec. 28, 2012 | (JP) | 2012-287713 |
| Dec. 28, 2012 | (JP) | 2012-287714 |
| Jul. 26, 2013 | (JP) | 2013-155218 |

(51) Int. Cl.

| | |
|---|---|
| ***C11D 1/29*** | (2006.01) |
| ***C11D 1/72*** | (2006.01) |
| ***C11D 1/83*** | (2006.01) |
| ***C11D 3/43*** | (2006.01) |
| ***B08B 3/04*** | (2006.01) |
| ***C11D 11/00*** | (2006.01) |
| ***C11D 3/20*** | (2006.01) |

(52) U.S. Cl.

CPC ..... *C11D 11/0017* (2013.01); *C11D 1/83* (2013.01); *C11D 3/2003* (2013.01); *C11D 3/2041* (2013.01); *C11D 3/2065* (2013.01); *C11D 3/2068* (2013.01); *C11D 3/43* (2013.01); *C11D 1/29* (2013.01); *C11D 1/72* (2013.01)

(58) Field of Classification Search

CPC .... C11D 1/29; C11D 1/72; C11D 1/83; C11D 3/2003; C11D 3/43; B08B 3/04

See application file for complete search history.

(56) References Cited

U.S. PATENT DOCUMENTS

| | | | | |
|---|---|---|---|---|
| 2006/0211593 | A1* | 9/2006 | Smith | C11D 1/83 510/424 |
| 2010/0256035 | A1 | 10/2010 | Konishi et al. | |
| 2012/0115769 | A1 | 5/2012 | Nomura et al. | |
| 2012/0289448 | A1* | 11/2012 | Man | C11D 1/37 510/365 |

FOREIGN PATENT DOCUMENTS

| | | | |
|---|---|---|---|
| JP | 56-5896 | A | 1/1981 |
| JP | 2009-132823 | A | 6/2009 |
| JP | 2009-185252 | A | 8/2009 |
| JP | 2010-202720 | A | 9/2010 |
| JP | 2011-208130 | A | 10/2011 |
| JP | 2012-107102 | A | 6/2012 |
| JP | 2013-194212 | A | 9/2013 |
| WO | WO 2011/007891 | A1 | 1/2011 |

OTHER PUBLICATIONS

English machine translation of JP-2012-107102-A, published Jun. 7, 2012.

English machine translation of JP-2013-194212-A, published Sep. 30, 2013.

International Preliminary Report on Patentability and English translation of the Written Opinion of the International Searching Authority (forms PCT/IB/373 and PCT/ISA/237), issued Jun. 30, 2015, for International Application No. PCT/JP2013/084548.

International Search Report issued in PCT/JP2013/084548, mailed on Apr. 8, 2014.

* cited by examiner

*Primary Examiner* — Brian P Mruk

(74) *Attorney, Agent, or Firm* — Birch, Stewart, Kolasch & Birch, LLP

(57) ABSTRACT

Provided is a liquid detergent composition for clothing which is formed by blending (a) a nonionic surfactant represented by Formula (1), (b) an anionic surfactant represented by Formula (2), a predetermined amount of (c) an organic solvent having one or more hydroxyl groups, and water in which the mass ratio (b)/(a) of the blending amount of the component (b) to the blending amount of the component (a) is 0.5 or more and 10 or less.

17 Claims, No Drawings

LIQUID DETERGENT COMPOSITION FOR CLOTHING

FIELD OF THE INVENTION

The present invention relates to a liquid detergent composition for clothing and a method for washing clothing.

BACKGROUND OF THE INVENTION

In recent years, global energy problem, reduction in carbon dioxide emission, drought problem and the like have been more severe, and environmental consciousness has grown. Technologies on the highly concentrated type liquid detergent composition have been disclosed for a reduction in container resin amount, reduction in transportation fuel cost, a reduction in waste after use and the like. For example, a liquid detergent composition is disclosed in JP-A 2011-208130 which contains (a) a nonionic surfactant having an average added mole number of an alkyleneoxy group of 16 to 35, (b) an anionic surfactant having an alkyleneoxy group having 3 and/or 4 carbon atoms and (c) a specific solvent, and has a high surfactant concentration. In addition, a compound prepared by adding ethylene oxide to a secondary alcohol having 12 to 14 carbon atoms at 3 moles on average is used as an arbitrary component in Examples. It is described that the liquid detergent composition is excellent in low temperature storage stability, solubility in water and washing performance.

In addition, hitherto, an anionic surfactant has been known as a surfactant to be blended in the liquid detergent composition for clothing, and for example, an anionic surfactant having an ethyleneoxy group and a propyleneoxy group in the molecule has been used in the related art. In JP-A 56-5896, a detergent composition containing a cationic active agent and an anionic active agent having an ethyleneoxy group and a propyleneoxy group in the molecule is disclosed and it is described that a polyoxyethylene alkyl or an alkenyl ether can be blended.

A liquid detergent composition is disclosed in JP-A 2009-185252 in which a linear polyoxyalkylene alkyl ether sulfate ester salt and a polyoxyethylene alkyl ether having a low added mole number of ethylene oxide are concurrently used under a predetermined condition.

A liquid detergent composition is disclosed in JP-A 2012-107102 which contains a specific compound having a branched chain shape, a specific alkyl sulfate ester salt having an oxypropylene group and an oxyethylene group and an amphoteric surfactant and/or semipolar surfactant.

A liquid detergent composition is disclosed in JP-A 2010-202720 which contains a specific sulfate ester salt having an oxypropylene group and an oxyethylene group, a surfactant that can form an ionic composite with the sulfate ester salt and has at least one hydrocarbon group having 8 to 18 carbon atoms, an antibacterial metal ion, one or more kinds selected from a hydrotropic agent and an organic solvent and water under a predetermined condition.

Meanwhile, in the fully automatic washing machine for home use, more specifically, a drum type fully automatic washing machine for home use, a pulsator type fully automatic washing machine for home use or an agitator type fully automatic washing machine for home use, there is a model that is equipped with a laundering course (referred to as the speed course in some cases) capable of shortening the laundering time including the washing time, the rinsing time and the dewatering time in addition to the standard course. In the course to shorten the laundering time, the number of rinsing is decreased or the time to wash the clothing with the detergent composition is shortened. The washing time is generally set to from 10 minutes to 15 minutes in the standard course, but the washing time of the speed course is set to short time, for example, 5 minutes. In addition, there is a case where the user arbitrarily sets the washing time to 5 minutes. The user can shorten the time required for laundering and thus use time effectively by selecting the speed course. In addition, it is possible to diminish the quantity of electricity required for laundering. The effects such as a decrease in the number of rinsing and shortening of the washing time are obtained in the case of choosing a course to shorten the laundering time.

SUMMARY OF THE INVENTION

The invention relates to a liquid detergent composition for clothing formed by blending the following component (a), component (b) and component (c) and water, in which a total of a blending amount of the component (a) and a blending amount of the component (b) is 15% by mass or more and 70% by mass or less with respect to a total mass of the entire blended raw materials, and a mass ratio of the blending amount of the component (b) to the blending amount of the component (a) is 0.5 or more and 7 or less by component (b)/component (a):

component (a): a nonionic surfactant represented by the following Formula (1):

$$R^1O\text{-}(EO)_mH \quad (1)$$

[in Formula (1), $R^1$ represents a hydrocarbon group having 8 or more and 18 or less carbon atoms, EO represents an ethyleneoxy group, and m represents an average added mole number and m is a number of 1 or more and 10 or less];

component (b): an anionic surfactant represented by the following Formula (2):

$$R^2O\text{-}[(A^1O)_p/(EO)_q]\text{—}SO_3M \quad (2)$$

[in Formula (2), $R^2$ represents a hydrocarbon group having 8 or more and 22 or less carbon atoms, $A^1O$ represents an alkyleneoxy group selected from an alkyleneoxy group having 3 carbon atoms and an alkyleneoxy group having 4 carbon atoms, EO represents an ethyleneoxy group, and p and q each represent an average added mole number, p is a number of 1 or more and 5 or less and q is a number of 0 or more and 10 or less, the notation "/" indicates that the $(A^1O)_p$ group and the $(EO)_q$ group are bonded to each other in block in random order, and M represents a cation]; and component (c): an organic solvent having one or more hydroxyl groups at 5% by mass or more and 40% by mass or less with respect to the total mass of the entire blended raw materials.

The invention relates to a liquid detergent composition for clothing formed by blending the following component (a), component (b) and component (c) and water, in which a total of a blending amount of the component (a) and a blending amount of the component (b) is 15% by mass or more and 70% by mass or less, and a mass ratio of the blending amount of the component (b) to the blending amount of the component (a) is 0.5 or more and 10 or less by component (b)/component (a):

component (a): a nonionic surfactant represented by the following Formula (1):

$$R^1O\text{-}(EO)_mH \quad (1)$$

[in Formula (1), $R^1$ represents a hydrocarbon group having 8 or more and 18 or less carbon atoms, EO represents an ethyleneoxy group, and m represents an average added mole number and m is a number of 1 or more and 10 or less];

component (b): an anionic surfactant represented by the following Formula (2-1):

$$R^2O\text{-}(A^1O)_p\text{-}(EO)_q\text{—}SO_3M \quad (2\text{-}1)$$

[in Formula (2-1), $R^2$ represents a hydrocarbon group having 8 or more and 22 or less carbon atoms, $A^1O$ represents an alkyleneoxy group selected from an alkyleneoxy group having 3 carbon atoms and an alkyleneoxy group having 4 carbon atoms, EO represents an ethyleneoxy group, and p and q each represent an average added mole number, p is a number of 0.5 or more and 5 or less and q is a number of 0 or more and 10 or less, and M represents a cation]; and component (c): an organic solvent having one or more hydroxyl groups at 5% by mass or more and 40% by mass or less (% by mass is % by mass with respect to the total of the entire blended raw materials).

The invention relates to a liquid detergent composition for clothing formed by blending the following component (a), component (b) and component (c) and water, in which a mass ratio of a blending amount of the component (b) to a blending amount of the component (a) is 0.4 or more and 10 or less by component (b)/component (a):

component (a): a nonionic surfactant represented by the following Formula (1):

$$R^1O\text{-}(EO)_mH \quad (1)$$

[in Formula (1), $R^1$ represents a hydrocarbon group having 8 or more and 18 or less carbon atoms, EO represents an ethyleneoxy group, and m represents an average added mole number and m is a number of 1 or more and 10 or less];

component (b): an anionic surfactant represented by the following Formula (2-2):

$$R^2O\text{-}(EO)_q\text{-}(A^1O)_p\text{—}SO_3M \quad (2\text{-}2)$$

[in Formula (2-2), $R^2$ represents a hydrocarbon group having 8 or more and 22 or less carbon atoms, $A^1O$ represents an alkyleneoxy group selected from an alkyleneoxy group having 3 carbon atoms and an alkyleneoxy group having 4 carbon atoms, EO represents an ethyleneoxy group, and p and q each represent an average added mole number, p is a number of 0.5 or more and 5 or less and q is a number of 0.5 or more and 5 or less; and M represents a cation]; and component (c): an organic solvent having one or more hydroxyl groups in the molecule at 5% by mass or more and 40% by mass or less (% by mass is % by mass with respect to the total of the entire blended raw materials).

The invention relates to a liquid detergent composition for clothing formed by blending the following component (a), component (b) and component (c) and water, in which a mass ratio of a blending amount of the component (b) to a blending amount of the component (a) is 0.5 or more and 5 or less by component (b)/component (a):

component (a): a nonionic surfactant represented by the following Formula (1):

$$R^1O\text{-}(EO)_mH \quad (1)$$

[in Formula (1), $R^1$ represents a hydrocarbon group having 8 or more and 18 or less carbon atoms, EO represents an ethyleneoxy group, and m represents an average added mole number and m is a number of 1 or more and 10 or less];

component (b): an anionic surfactant represented by the following Formula (2-1):

$$R^2O\text{-}(A^1O)_p\text{-}(EO)_q\text{—}SO_3M \quad (2\text{-}1)$$

[in Formula (2-1), $R^2$ represents a hydrocarbon group having 8 or more and 22 or less carbon atoms, $A^1O$ represents an alkyleneoxy group selected from an alkyleneoxy group having 3 carbon atoms and an alkyleneoxy group having 4 carbon atoms, EO represents an ethyleneoxy group, and p and q represent an average added mole number, p is a number of 0.5 or more and 5 or less, q is a number of 0 or more and 10 or less, and M represents a cation]; and component (c): an organic solvent having one or more hydroxyl groups in the molecule at 5% by mass or more and 40% by mass or less (% by mass is % by mass with respect to the total of the entire blended raw materials).

In addition, the invention relates to a method for washing clothing, the method including washing clothing with a washing liquid containing water and the liquid detergent composition for clothing according to the invention described above at 0.01% by mass or more and 0.1% by mass or less and having a temperature of 0° C. or higher and 35° C. or lower for 1 minute or longer and 7 minutes or shorter under a condition in which a bath ratio expressed by a ratio of an amount of the washing liquid (L) to a mass of clothing is amount of washing liquid (L)/mass of clothing (kg)=3 or more and 50 or less.

DETAILED DESCRIPTION OF THE INVENTION

There is no description suggesting an improvement in washing speed in JP-A 2011-208130. There is no description suggesting an improvement in washing speed in JP-A 56-5896.

In the case of laundering by the speed course as described above, the user expects the same degree of stain removal as the normal laundering course despite a short washing time. However, it has been found out that a decrease in washing performance tends to be greater than the extent expected from the shortened washing time when the washing time is shortened.

The invention provides a liquid detergent composition for clothing which exerts sufficient detergency despite a short washing time. Specifically, a liquid detergent composition for clothing which can achieve detergency equivalent to the laundering time of 10 minutes in a washing time of 5 minutes is provided.

According to the invention, a liquid detergent composition for clothing which exerts sufficient detergency despite a short washing time is provided. The liquid detergent composition for clothing of the invention can achieve detergency equivalent to the standard course having a sufficient washing time even in the case of choosing the speed course. In addition, the liquid detergent composition for clothing of the invention is excellent not only in the washing speed for sebum stains but also in the washing performance for the spilled food stains which are especially difficult to be removed.

The present inventors have found out that when the component (a) and the component (b) are blended in specific blending amounts at a specific mass ratio and the component (c) is used in combination, the same detergency as the standard course having a sufficient washing time can be achieved even for a shorter washing time. Hereinafter, the invention will be described, but there is a case where the meaning that "it is possible to achieve detergency equivalent to or higher than that of the standard course having a sufficient washing time despite a short washing time" is expressed as "the washing speed is fast" or "it is possible to improve the washing speed".

<Component (a)>

The nonionic surfactant of the component (a) used in the invention is a compound represented by the following Formula (1).

$$R^1O\text{-}(EO)_mH \quad (1)$$

[in Formula (1), $R^1$ represents a hydrocarbon group having 8 or more and 18 or less carbon atoms, EO represents an ethyleneoxy group, and m represents an average added mole number and m is a number of 1 or more and 10 or less.]

$R^1$ in Formula (1) of the component (a) represents a hydrocarbon group having 8 or more and 18 or less carbon atoms and is preferably a hydrocarbon group having 10 or more and even preferably 11 or more, and 16 or less and even preferably 14 or less carbon atoms from the viewpoint of detergency. As the hydrocarbon group of $R^1$, an alkyl group, or an alkenyl group is preferable and an alkyl group is more preferable from the viewpoint of detergency. $R^1$ is preferably a linear or branched hydrocarbon group and more preferably a linear hydrocarbon group from the viewpoint of detergency. A linear hydrocarbon group of R1 is a linear primary hydrocarbon group from the viewpoint of detergency. In addition, $R^1$ is preferably a group selected from a branched primary hydrocarbon group and a linear secondary hydrocarbon group from the viewpoint that it is possible to improve the washing speed. The carbon atom of $R^1$ bonded to the oxygen atom in Formula (1) may be a primary carbon atom or a secondary carbon atom. The carbon atom of $R^1$ bonded to the oxygen atom in Formula (1) is preferably a linear primary hydrocarbon group from the viewpoint of detergency and is preferably a secondary carbon atom from the viewpoint that it is possible to improve the washing speed. $R^1$ is preferably a linear primary alkyl group having 10 or more and 16 or less carbon atoms from the viewpoint of detergency. $R^1$ is preferably a group selected from a branched primary alkyl group having 10 or more and 16 or less carbon atoms and a linear secondary alkyl group having 10 or more and 16 or less carbon atoms from the viewpoint that it is possible to improve the washing speed.

The method to obtain the compound of Formula (1) is not particularly limited, and the compound can be obtained by subjecting an alcohol having a hydrocarbon group having 8 or more and 18 or less carbon atoms to the addition reaction of ethylene oxide. The average added mole number m of ethylene oxide is 1 or more and 10 or less. m is 1 or more, preferably 2 or more, more preferably 2.5 or more and even more preferably 3 or more from the viewpoint of detergency for sebum stains. In addition, m is 10 or less, preferably 9 or less and more preferably 8 or less from the viewpoint that it is possible to improve the washing speed and from the viewpoint of detergency when the liquid detergent is directly applied to the spilled food stains.

The component (a) is preferably a nonionic surfactant in which $R^1$ in Formula (1) is a linear primary or secondary alkyl group having 10 or more and 14 or less carbon atoms and m that represents an average added mole number is a number of 3 or more and 8 or less from the viewpoint of detergency.

In addition, the component (a) is preferably the component (a) which contains a nonionic surfactant (a1) [hereinafter, referred to as the component (a1)] selected from a nonionic surfactant represented by Formula (1) in which $R^1$ is a branched primary hydrocarbon group and a nonionic surfactant represented by Formula (1) in which $R^1$ is a linear secondary hydrocarbon group from the view point that it is possible to improve the washing speed. It is preferable that the component (a1) represented by Formula (1) in which the hydrocarbon group of $R^1$ be an alkyl group. Hence, the component (a1) is preferably a nonionic surfactant selected from a nonionic surfactant represented by Formula (1) in which $R^1$ is a branched primary alkyl group having 8 or more and 18 or less carbon atoms and a nonionic surfactant represented by Formula (1) in which $R^1$ is a linear secondary alkyl group having 8 or more and 18 or less carbon atoms. In the case of using the component (a1), it is preferable that the proportion of the component (a1) in the component (a) be 50% by mass or more, even 70% by mass or more and even 90% by mass or more.

Moreover, the component (a) is preferably a combination of the component (a1) described above and a nonionic surfactant (a2) [hereinafter, referred to as the component (a2)] in which $R^1$ in Formula (1) is a linear primary hydrocarbon group from the viewpoint that it is possible to improve the washing speed. In the case of using the component (a1) and the component (a2), the proportion of the total of the component (a1) and the component (a2) in the component (a) is preferably 50% by mass or more from the viewpoint that it is possible to improve the washing speed, and the proportion is more preferably 70% by mass or more and more preferably 90% by mass or more.

An even more preferred aspect of the component (a) is that the component (a) contains the component (a1) and the component (a2) and the blending ratio of the component (a1) to the component (a2), the mass ratio of the component (a1)/component (a2), is preferably 0.5 or more, more preferably 0.7 or more, more preferably 0.9 or more and more preferably 1.0 or more from the viewpoint that it is possible to improve the washing speed, and the blending ratio of the component (a1) to the component (a2) is preferably 7 or less, more preferably 5 or less, more preferably 4 or less, more preferably 3 or less and more preferably 2 or less from the viewpoint of detergency for the spilled food stains attached to clothing.

The mass ratio of the component (a1)/component (a2) is preferably from 0.7 to 5, more preferably from 0.9 to 3 and more preferably from 1.0 to 2 from the viewpoint that it is possible to achieve both an improvement in washing speed and detergency for the spilled food stains attached to clothing.

<Component (b)>

It is possible to obtain a liquid detergent composition for clothing which can improve the washing speed by blending the component (b) with the component (a) at a specific ratio and concurrently using a specific amount of the component (c).

The component (b) is an anionic surfactant represented by the following Formula (2).

$$R^2O\text{-}[(A^1O)_p/(EO)_q]\text{—}SO_3M \quad (2)$$

[in Formula (2), $R^2$ represents a hydrocarbon group having 8 or more and 22 or less carbon atoms, $A^1O$ represents an alkyleneoxy group selected from an alkyleneoxy group having 3 carbon atoms and an alkyleneoxy group having 4 carbon atoms, EO represents an ethyleneoxy group, and p and q each represent an average added mole number, p is a number of 1 or more and 5 or less and q is a number of 0 or more and 10 or less, the notation "/" indicates that the $(A^1O)_p$ group and the $(EO)_q$ group are bonded to each other in block in random order, and M represents a cation].

As the component (b), an anionic surfactant selected from an anionic surfactant [hereinafter, referred to as the component (b1)] represented by the following Formula (2-1) and an anionic surfactant [hereinafter, referred to as the component (b2)] represented by the following Formula (2-2) is mentioned.

$$R^2O\text{-}(A^1O)_{p1}\text{-}(EO)_{q1}\text{—}SO_3M \quad (2\text{-}1)$$

[in Formula (2-1), $R^2$ represents a hydrocarbon group having 8 or more and 22 or less carbon atoms, $A^1O$ represents an alkyleneoxy group selected from an alkyleneoxy group having 3 carbon atoms and an alkyleneoxy group having 4 carbon atoms, EO represents an ethyleneoxy group, and p1 and q1 each represent an average added mole number, p1 is a number of 1 to 5 and q1 is a number of 0 to 10, and M represents a cation.]

$$R^2O\text{-}(EO)_{q2}\text{-}(A^1O)_{p2}\text{—}SO_3M \quad (2\text{-}2)$$

[in Formula (2-2), $R^2$ represents a hydrocarbon group having 8 or more and 22 or less carbon atoms, $A^1O$ represents an alkyleneoxy group selected from an alkyleneoxy group having 3 carbon atoms and an alkyleneoxy group having 4 carbon atoms, EO represents an ethyleneoxy group, and p2 and q2 each represent an average added mole number, p2 is a number of 1 to 5 and q2 is a number of 0.5 to 5, and M represents a cation.]

The anionic surfactant of the component (b1) used in the invention is a compound represented by the following Formula (2-1).

$$R^2O\text{-}(A^1O)_{p1}\text{-}(EO)_{q1}\text{—}SO_3M \quad (2\text{-}1)$$

[in Formula (2-1), $R^2$ represents a hydrocarbon group having 8 or more and 22 or less carbon atoms, $A^1O$ represents an alkyleneoxy group selected from an alkyleneoxy group having 3 carbon atoms and an alkyleneoxy group having 4 carbon atoms, EO represents an ethyleneoxy group, and p1 and q1 each represent an average added mole number, p1 is a number of 1 or more and 5 or less and q1 is a number of 0 or more and 10 or less, and M represents a cation.]

$R^2$ in Formula (2-1) of the component (b1) represents a hydrocarbon group having 8 or more and 22 or less carbon atoms. $R^2$ preferably has 8 or more, 10 or more and even preferably 12 or more, and 16 or less and even preferably 14 or less carbon atoms from the viewpoint of detergency. The hydrocarbon group of $R^2$ is preferably an alkyl group and an alkenyl group and more preferably an alkyl group from the viewpoint of detergency. $R^2$ is preferably a linear hydrocarbon group, even preferably a linear alkyl group and even preferably a linear primary alkyl group from the viewpoint of detergency or availability of the raw materials. $R^2$ is preferably an alkyl group having 12 or more and 14 or less carbon atoms, even preferably a linear alkyl group and even preferably a linear primary alkyl group. The carbon atom of $R^2$ bonded to the oxygen atom in Formula (2-1) is preferably a primary carbon atom from the viewpoint of detergency when the liquid detergent composition is directly applied to the spilled food stains.

Examples of the alkyleneoxy group having 3 or 4 carbon atoms which is $A^2O$ in Formula (2-1) include one or more kinds of groups selected from an oxytrimethylene group, an oxypropan-1,2-diyl group, an oxybutan-1,2-diyl group, an oxybutan-1,3-diyl group, an oxybutan-2,3-diyl group and an oxytetramethylene group. It is preferably one or more kinds of groups selected from an oxypropan-1,2-diyl group [generally called a propyleneoxy group in some cases] and an oxybutan-1,2-diyl group (generally called a butyleneoxy group in some cases) and more preferably an oxypropan-1,2-diyl group from the viewpoint of availability.

p1 in Formula (2-1) represents the average added mole number of $A^1O$ and is a number of 1 or more and 5 or less. p1 is preferably 1.1 or more, more preferably 1.2 or more, more preferably 1.3 or more, more preferably 1.4 or more, more preferably 1.5 or more and more preferably 1.8 or more from the viewpoint of detergency for sebum stains. p1 is 5 or less, preferably 4 or less, more preferably 3 or less, more preferably 3.0 or less, more preferably 2.9 or less, more preferably 2.8 or less and more preferably 2.5 or less from the viewpoint that it is possible to improve the washing speed. The component (b1) is preferably an anionic surfactant in which p1 in Formula (2-1) is a number of 1 or more and 3 or less from the viewpoint that it is possible to improve the washing speed.

q1 in Formula (2-1) represents the average added mole number of EO and is a number of 0 or more and 10 or less from the viewpoint of detergency. q1 is preferably a number of 0.5 or more, more preferably 0.8 or more, more preferably 1 or more, more preferably 1.5 or more, more preferably 1.8 or more and more preferably 2 or more from the viewpoint of further increasing the washing speed. q1 is a number of 10 or less, preferably 8 or less, more preferably 5 or less and more preferably 3 or less from the viewpoint of detergency. Incidentally, $(A^1O)_{p1}$ and $(EO)_{q1}$ are bonded to $R^20$ in block in the order of $(A^1O)_{p1}$ and $(EO)_{q1}$ in a case where q1 is not 0.

In addition, M in Formula (2-1) represents a cation. Preferred examples of M include a hydrogen ion, an alkali metal ion, an alkaline earth metal ion, an ammonium ion and an alkanolammonium ion having 1 or more and 6 or less carbon atoms.

Examples of the alkali metal ion include a sodium ion, a potassium ion and a lithium ion, examples of the alkaline earth metal ion include a magnesium ion, and examples of the alkanolammonium ion having 1 or more and 6 or less carbon atoms include a monoethanolammonium ion and a triethanolammonium ion. Among these, an alkali metal ion such as a sodium ion and a potassium ion and a monoethanolammonium ion are preferable and a monoethanolammonium ion is more preferable from the viewpoint of detergency.

The preparation method of the anionic surfactant represented by Formula (2-1) is not particularly limited. For example, an intermediate compound (1) is obtained by adding an alkylene oxide having 3 or 4 carbon atoms, preferably propylene oxide in an amount of preferably 1.0 mole or more, more preferably 1.1 moles or more, more preferably 1.2 moles or more, more preferably 1.3 moles or more, more preferably 1.4 moles or more, more preferably 1.5 moles or more and more preferably 1.8 moles or more and 5 moles or less, preferably 4 moles or less, more preferably 3 moles or less, more preferably 3.0 moles or less, more preferably 2.9 moles or less, more preferably 2.8 moles or less and more preferably 2.5 moles or less to 1 mole of an alcohol having a hydrocarbon group having 8 or more and 22 or less carbon atoms, preferably a linear primary aliphatic saturated alcohol having 10 or more and 14 or less carbon atoms. Next, an intermediate compound (2) is obtained by adding ethylene oxide to the intermediate compound (1) in an amount of 0 mole or more, preferably 0.5 mole or more, more preferably 0.8 mole or more, more preferably 1 mole or more, more preferably 1.5 moles or more, more preferably 1.8 moles or more and more preferably 2 moles or more and 10 moles or less, preferably 8 moles or less is more preferably 5 moles or less and more preferably 3 moles or less.

Next, the intermediate compound (2) is sulfated, and in some cases, thereafter neutralized, so that the anionic surfactant represented by Formula (2-1) can be obtained.

The anionic surfactant of the component (b2) used in the invention is a compound represented by the following Formula (2-2).

$$R^2O\text{-}(EO)_{q2}\text{-}(A^1O)_{p2}\text{—}SO_3M \quad (2\text{-}2)$$

[in Formula (2-2), $R^2$ represents a hydrocarbon group having 8 or more and 22 or less carbon atoms, $A^1O$ represents an alkyleneoxy group selected from an alkyleneoxy group having 3 carbon atoms and an alkyleneoxy group having 4 carbon atoms, EO represents an ethyleneoxy group, and p2 and q2 each represent an average added mole number, p2 is a number of 1 or more and 5 or less and q2 is a number of 0.5 or more and 5 or less, and M represents a cation.]

The specific examples and preferred examples of $R^2$, $A^1O$ and M in Formula (2-2) of the component (b2) are the same as those in Formula (2-1) of the component (b).

q2 in Formula (2-2) represents the average added mole number of EO and is a number of 0.5 or more and 5 or less. q2 is preferably 0.8 or more, more preferably 1 or more, more preferably 1.5 or more and more preferably 1.8 or more from the viewpoint that it is possible to improve the washing speed. q2 is preferably 5 or less, more preferably 4 or less, more preferably 3 or less and more preferably 2.5 or less from the viewpoint of detergency for sebum stains.

p2 in Formula (2-2) represents the average added mole number of $A^1O$ and is a number of 1 or more and 5 or less. p2 is a number of 1 or more, preferably 1.5 or more and more preferably 1.8 or more from the viewpoint that it is possible to improve the washing speed. p2 is a number of 5 or less, preferably 4 or less, more preferably 3 or less and more preferably 2.5 or less from the viewpoint of detergency.

The preparation method of the anionic surfactant represented by Formula (2-2) is not particularly limited. For example, an intermediate compound (1') is obtained by adding an ethylene oxide to an alcohol having a hydrocarbon group having 8 or more and 22 or less carbon atoms, preferably 1 mole of a linear primary aliphatic saturated alcohol having 10 or more and 14 or less carbon atoms in an amount of 0.5 mole or more, preferably 0.8 mole or more, more preferably 1 mole or more, more preferably 1.5 moles or more and more preferably 1.8 moles or more and 5 moles or less, preferably 4 moles or less, more preferably 3 moles or less and more preferably 2.5 moles or less. Next, an intermediate compound (2') is obtained by adding an alkylene oxide having 3 carbon atoms and/or an alkylene oxide having 4 carbon atoms, preferably propylene oxide to the intermediate compound (1') in an amount of 1 mole or more, preferably 1.5 moles or more and more preferably 1.8 moles or more and 5 moles or less, preferably 4 moles or less, more preferably 3 moles or less and more preferably 2.5 moles or less. Next, the intermediate compound (2') is sulfated, and in some cases, thereafter neutralized, so that the anionic surfactant represented by Formula (2-2) can be obtained.

<Component (c)>

In the liquid detergent composition for clothing of the invention formed by blending the component (a) and the component (b) at a specific ratio, (c) an organic solvent having one or more hydroxyl groups is further blended from the viewpoint that it is possible to improve the washing speed and from the viewpoint of detergency when the liquid detergent composition is directly applied to the spilled food stains. Furthermore, the component (c) is preferably an organic solvent having a hydroxyl group and an ether group from the viewpoint that it is possible to improve the washing speed.

As the organic solvent having one or more hydroxyl groups, one or more kinds of compounds represented by the following component (c1) to component (c6) are used.

Component (c1): a monohydric alcohol having an aliphatic hydrocarbon group having 2 or more and 6 or less carbon atoms.

Examples thereof include a monohydric alcohol selected from ethanol, 1-propanol, 2-propanol and 1-butanol.

Component (c2): a dihydric or higher and hexahydric or lower alcohol [excluding the component (c3)] having 2 or more and 6 or less carbon atoms.

Examples thereof include a dihydric or trihydric alcohol selected from ethylene glycol, propylene glycol, butylene glycol, hexylene glycol (2-methyl-2,4-pentanediol), 1,5-pentanediol, 1,6-hexanediol and glycerol.

Component (c3): a polyalkylene glycol containing an alkylene glycol unit having 2 or more and 4 or less carbon atoms.

Examples thereof include a polyalkylene glycol selected from diethylene glycol, triethylene glycol, tetraethylene glycol, dipropylene glycol, tripropylene glycol, polyethylene glycol having a weight average molecular weight of 400 or more and 4000 or less and polypropylene glycol having a weight average molecular weight of 400 or more and 4000 or less.

Component (c4): a monoalkyl ether of a (mono or poly) alkylene glycol having an alkylene glycol unit having 2 or more and 4 or less carbon atoms and an alkyl group having 1 or more and 4 or less carbon atoms.

Examples thereof include a compound selected from diethylene glycol monomethyl ether, triethylene glycol monomethyl ether, diethylene glycol monoethyl ether, dipropylene glycol monomethyl ether, dipropylene glycol monoethyl ether, tripropylene glycol monomethyl ether, diethylene glycol monobutyl ether, 1-methoxy-2-propanol and 1-ethoxy-2-propanol.

Component (c5): an alkyl glyceryl ether having an alkyl group having 1 or more and 8 or less carbon atoms.

Examples thereof include an alkyl glyceryl ether selected from 1-methyl glycerol ether, 2-methyl glycerol ether, 1,3-dimethyl glycerol ether, 1-ethyl glycerol ether, 1,3-diethyl glycerol ether, triethyl glycerol ether, 1-pentyl glyceryl ether, 2-pentyl glyceryl ether, 1-octyl glyceryl ether and 2-ethylhexyl glyceryl ether.

Component (c6): an aromatic alkyl ether of (mono or poly)alkylene glycol having an alkylene glycol unit having 2 or 3 carbon atoms.

Examples thereof include a compound selected from 2-phenoxyethanol, diethylene glycol monophenyl ether, triethylene glycol monophenyl ether, polyethylene glycol monophenyl ether having an average molecular weight of about 480, 2-benzyloxy ethanol and diethylene glycol monobenzyl ether.

The term "(mono or poly)alkylene glycol" in the component (c4) and the component (c6) described above refers to a monoalkylene glycol or polyalkylene glycol. In addition, the "polyalkylene glycol" means that an alkylene glycol unit is contained in an amount of 2 or more and 9 or less.

As the component (c), it is preferable to use one or more kinds selected from the component (c1) to the component (c6) described above from the viewpoint that it is possible to improve the washing speed. From the viewpoint of further increasing the washing speed, it is preferable to use one or more kinds of compounds selected from the component (c1), the component (c2), the component (c4) and the component (c6), it is more preferable to use one or more kinds of compounds selected from the component (c2) and the component (c4), and more specifically it is preferable to use one or more kinds of compounds selected from ethanol, propylene glycol, diethylene glycol monobutyl ether, 2-phenoxyethanol, diethylene glycol monophenyl ether and triethylene glycol monophenyl ether. In the invention, it is preferable to use one or more kinds of organic solvents selected from propylene glycol and diethylene glycol monobutyl ether, and even diethylene glycol monobutyl ether, as the component (c).

<Water>

The liquid detergent composition for clothing of the invention contains water in order to be in a liquid state at from 4° C. to 40° C. It is possible to use deionized water (also referred to as ion exchanged water in some cases) or water obtained by adding sodium hypochlorite to ion exchanged water at 1 mg/kg or more and 5 mg/kg or less as water. In addition, tap water can also be used.

<Liquid Detergent Composition for Clothing>

The liquid detergent composition for clothing of the invention is formed by blending the component (a), the component (b), the component (c) and water as well as an arbitrary component. Hereinafter, the "% by mass" is based on the total mass of the entire blended raw materials unless otherwise specified. In addition, the blending amount of each component can be read as the content in the composition.

In the liquid detergent composition for clothing of the invention, the mass ratio of the blending amount of the component (b) to the blending amount of the component (a) is 0.5 or more and 7 or less by component (b)/component (a). The mass ratio of the component (b)/component (a) is 0.5 or more, preferably 0.7 or more and is more preferably 0.9 or more from the viewpoint that it is possible to improve the washing speed. The mass ratio of the component (b)/component (a) is preferably 1.0 or more, more preferably 1.1 or more, more preferably 1.2 or more and more preferably 1.5 or more from the viewpoint that it is possible to improve the washing speed, to maintain washing performance for the spilled food stains which are hardly removed and to improve washing performance for sebum stains. The mass ratio of the component (b)/component (a) is preferably 6 or less and more preferably 5 or less from the viewpoint that the washing speed can be maintained even when the blending amount of the component (c) is smaller. In addition, the mass ratio of the component (b)/component (a) is preferably 5 or less, more preferably 4 or less, more preferably 3 or less, more preferably 2.5 or less and more preferably 2 or less from the viewpoint of detergency for spilled food stains. The mass ratio of the component (b)/component (a) is more preferably 1.8 or less from the viewpoint that it is possible to improve the washing speed and washing performance for spilled food stains which are hardly removed exhibits. Incidentally, the component (b) is not a salt but a compound in an acid form, that is, the mass of the compound of which the counter ion is assumed to be a hydrogen ion is regarded as the mass of the component (b) for calculating the mass ratio or % by mass.

In the liquid detergent composition for clothing of the invention, the total of the blending amount of the component (a) and the blending amount of the component (b) is 15% by mass or more, preferably 20% by mass or more, more preferably 30% by mass or more and more preferably 40% by mass or more from the viewpoint that enhanced washability is obtained in a certain used amount and the amount of the composition per one use can be decreased. In addition, the total of the blending amount of the component (a) and the blending amount of the component (b) is 70% by mass or less, preferably 65% by mass or less and more preferably 60% by mass or less from the viewpoint that it is possible to improve the washing speed.

The blending amount of the component (c) is 5% by mass or more, preferably 8% by mass or more, preferably 10% by mass or more and more preferably 13% by mass or more from the viewpoint that it is possible to improve the washing speed. The blending amount of the component (c) is 40% by mass or less, preferably 35% by mass or less and more preferably 25% by mass or less from the viewpoint of economic efficiency or storage stability.

In addition, the mass ratio of the blending amount of the component (c) to the blending amount of the component (a) and the blending amount of the component (b) is preferably 0.07 or more, more preferably 0.1 or more, more preferably 0.15 or more, more preferably 0.2 or more and more preferably 0.25 or more by component (c)/[component (a)+component (b)] from the viewpoint that it is possible to improve the washing speed. The mass ratio is preferably 3 or less, more preferably 2 or less, more preferably 1 or less and more preferably 0.5 or less from the viewpoint of economic efficiency and storage stability.

In addition, the mass ratio of the blending amount of the component (a) to the blending amount of the component (c) is 0.5 or more and preferably 2.5 or less by component (a)/component (c) from the viewpoint of an improvement in washing speed for sebum stains and an improvement in washability for spilled food stains. The mass ratio of the component (a)/component (c) is preferably 0.6 or more and more preferably 0.8 or more from the viewpoint of economic efficiency. The mass ratio of the component (a)/component (c) is preferably 2.4 or less, more preferably 2.2 or less, more preferably 2.0 or less, more preferably 1.8 or less, more preferably 1.6 or less and more preferably 1.4 or less from the viewpoint of an improvement in washing speed.

In addition, in the liquid detergent composition for clothing of the invention, the total of the blending amount of the component (a), the blending amount of the component (b) and the blending amount of the component (c) is preferably 40% by mass or more and 90% by mass or less. The total of the blending amount of the component (a), the blending amount of the component (b) and the blending amount of the component (c) is more preferably 50% by mass or more, more preferably 52% by mass or more and 55% by mass or more and more preferably 80% by mass or less, more preferably 70% by mass or less and more preferably 65% by mass or less.

It is possible to improve the washing speed as the composition of the invention is rapidly dispersed when added to water to be used for washing. The blending proportion of water in the composition of the invention is more preferably 5% by mass or more from this point of view. The blending proportion of water is preferably 30% by mass or less, more preferably 25% by mass or less, more preferably 20% by mass or less, more preferably 15% by mass or less and more preferably 10% by mass or less from the viewpoint that it is possible to blend the component (a) and the component (b) described above and the component (d) to be described below at high concentrations.

<Arbitrary Component>

In the liquid detergent composition for clothing of the invention, the following component (d) may be further blended from the viewpoint that it is possible to improve washability for sebum stains while maintaining the washing speed for sebum stains.

Component (d): a nonionic surfactant represented by the following Formula (3):

$$R^3O\text{-}(A^2O)_nH \quad (3)$$

[in Formula (3), $R^3$ represents a hydrocarbon group having 8 or more and 22 or less carbon atoms, $A^2O$ represents an alkyleneoxy group having 2 or more and 5 or less carbon atoms, n represents an average added mole number and is a number of 16 or more and 35 or less, and $A^2O$ contains an ethyleneoxy group having 2 carbon atoms at 16 moles or more on average, provided that when all of $A^2O$ are an ethyleneoxy group, n is a number of 18 or more.]

$R^3$ in Formula (3) of the component (d) is a hydrocarbon group having 8 or more and 22 or less carbon atoms, and the carbon number is preferably 10 or more, even preferably 12 or more and even preferably 14 or more, and 18 or less and even preferably 16 or less from the viewpoint of detergency for sebum stains. $R^3$ is preferably a linear hydrocarbon group from the viewpoint of availability of the raw materials. In addition, as the hydrocarbon group of $R^3$, an alkyl group and an alkenyl group are preferable and an alkyl group is more preferable. $R^3$ is preferably a linear or branched hydrocarbon group and more preferably a linear hydrocarbon group. In Formula (3), the carbon atom bonded to the oxygen atom of $R^3$ is preferably a primary carbon atom.

The method to obtain the compound of Formula (3) is not particularly limited, and the compound can be obtained by subjecting an alcohol having a hydrocarbon group having 8 or more and 22 or less carbon atoms to the addition reaction of an alkylene oxide having 2 or more and 5 or less carbon atoms. Incidentally, as the alkylene oxide in the compound of Formula (3), ethylene oxide is always used.

Here, the average added mole number n of an alkylene oxide having 2 or more and 5 or less carbon atoms is 16 or more and 35 or less. It is possible to improve washability while maintaining the washing speed since the component (d) is adsorbed, together with the component (a) and the component (b), on the sebum stains that are attached to clothing when n is 16 or more. In addition, washing performance is favorable when n is 35 or less. n is preferably 17 or more, more preferably 18 or more and more preferably more than 18. n is preferably 30 or less and more preferably 25 or less. In addition, the compound of Formula (3) contains an ethyleneoxy group that is an alkyleneoxy group having 2 carbon atoms at 14 moles or more on average, preferably 15 moles or more on average, more preferably 16 moles or more on average and more preferably 18 moles or more on average as $(A^2O)_n$. All of $A^2O$ may be an ethyleneoxy group, and n is 18 or more in that case. It is preferable that $A^2O$ other than EO be a propyleneoxy group (also referred to as an oxypropan-1,2-diyl group in some cases). In general, n may be a reaction proportion of an alkylene oxide having 2 or more and 5 or less carbon atoms with respect to the alcohol represented by $R^3OH$ at the time of the production of the component (d).

Meanwhile, a compound having an alkyleneoxy group with 3 or more and 5 or less carbon atoms as $A^2O$ is more excellent for elevated concentration than a compound wherein all $A^2O$s are an ethyleneoxy group, and the stability thereof can be easily maintained.

In addition, from the viewpoint of an improvement in washing performance for sebum stains, the component (d) preferably has a propyleneoxy group as $A^2O$, and further the component (d) is preferably a compound represented by the following Formula (3-1).

$$R^3O\text{—}[(C_2H_4O)_{n1}/(A^{21}O)_{n2}]\text{—}H \quad (3\text{-}1)$$

[in Formula (3-1), $R^3$ represents the same meaning as that in Formula (3), $A^{21}O$ represents an alkyleneoxy group having 3 or more and 5 or less carbon atoms. n1 and n2 each represent an average added mole number, n1 is a number of 15 or more and 30 or less and n2 is a number of 1 or more and 5 or less, the notation "/" indicates that the $C_2H_4O$ group and the $A^{21}O$ group may be bonded to each other in random or block, and in addition, $A^{21}O$ may be divided as a plurality of block bodies.]

It is possible to obtain the compound of Formula (3-1) by subjecting an alcohol having 8 or more and 22 or less carbon atoms to a random or block addition reaction of ethylene oxide and an alkylene oxide having 3 or more and 5 or less carbon atoms.

In addition, n1 in Formula (3-1) represents an average added mole number of the ethyleneoxy group of EO, and the lower limit value thereof is 15 or more, preferably 16 or more and more preferably 18 or more and the upper limit value thereof is 30 or less, preferably 27 or less and more preferably 24 or less from the viewpoint of storage stability, solubility and washing performance for sebum stains. n2 represents an average added mole number of an alkyleneoxy group having 3 or more and 5 or less carbon atoms, and the lower limit value thereof is 1 or more and preferably 2 or more and the upper limit value thereof is 5 or less, preferably 4 or less and more preferably 3 or less from the viewpoint of washing performance for sebum stains. In addition, n in Formula (3) and n1 and n2 in Formula (3-1) are in a relation of n=n1+n2.

The alkyleneoxy group having 3 or more and 5 or less carbon atoms that is $A^{21}O$ in Formula (3-1) is obtained by an addition reaction of an alkylene oxide having 3 or more and 5 or less carbon atoms. The alkyleneoxy group is preferably an alkyleneoxy group having 3 carbon atoms and/or an alkyleneoxy group having 4 carbon atoms, and specific examples thereof include a trimethyleneoxy group, an oxypropan-1,2-diyl group, an oxybutan-1,2-diyl group, an oxybutan-1,3-diyl group, an oxybutan-2,3-diyl group and an oxytetramethylene group. $A^{21}O$ is preferably an oxypropan-1,2-diyl group (hereinafter, the oxypropan-1,2-diyl group may also be referred to as a propyleneoxy group or a PO group in some cases in the invention).

In the invention, it is more preferable to use a compound in which the average added mole number n1 of the ethyleneoxy group is 15 or more, even 16 or more and even 18 or more, and 27 or less, even 24 or less and even 22 or less and the average added mole number n2 of the propyleneoxy group of PO is 1 or more and 2 or more, and 4 or less and even 3 or less from the viewpoint of obtaining a liquid detergent composition excellent in low-temperature storage stability, solubility in cold water and washing performance.

The notation "/" in Formula (3-1) indicates that the relation between the ethyleneoxy group (hereinafter, referred to as EO in some cases) of the $C_2H_4O$ group and the $A^{21}O$ group of the component (d) of the invention may be a random bond or a block bond. In addition, $A^{21}O$ may be divided as a plurality of block bodies.

Examples of a more specific structure of Formula (3-1) above include one or more kinds of compounds selected from the following Formulas (3-1-1) to (3-1-5):

$$R^3O\text{-}(A^{21}O)_{n2}\text{—}(C_2H_4O)_{n1}\text{—}H \quad (3\text{-}1\text{-}1)$$

$$R^3O\text{—}(C_2H_4O)_{n1}\text{-}(A^{21}O)_{n2}\text{—}H \quad (3\text{-}1\text{-}2)$$

$$R^3O\text{—}[(C_2H_4O)_{n11}\cdot(A^{21}O)_{n2}]\text{—}(C_2H_4O)_{n12}\text{—}H \quad (3\text{-}1\text{-}3)$$

$$R^3O—(C_2H_4O)_{n11}-[(A^{21}O)_{n2}\cdot(C_2H_4O)_{n12}]—H \quad (3\text{-}1\text{-}4)$$

$$R^3O—(C_2H_4O)_{n11}-(A^{21}O)_{n2}—(C_2H_4O)_{n12}—H \quad (3\text{-}1\text{-}5)$$

[in Formulas, $R^3O$, n1, n2 and $(A^{21}O)$ represent the same meanings as those described above, and n11 and n12 each represent an average added mole number and n1=n11+n12. The notation "·" indicates that it is a random bond. In addition, $A^{21}O$ may be divided as a plurality of block bodies.]

The compounds represented by Formulas (3-1-1) to (3-1-5) can be prepared by considering the reaction proportion of an alkylene oxide to $R^3OH$ and the reaction sequence.

The compound represented by Formula (3-1) in which $R^3$ bonded to the oxygen atom of $R^3O$— is a linear primary alkyl group is superior in detergency to the compound in which $R^3$ is a linear secondary alkyl group. The compound in which $R^3$ is a linear primary alkyl group is more preferable. In a case where $R^3$ is a linear primary alkyl group, one or more kinds of compounds selected from Formulas (3-1-2), (3-1-4) and (3-1-5) are preferable and one or more kinds of compounds selected from Formula (3-1-5) are more preferable among them from the viewpoint of detergency for sebum stains. It is more preferable that the proportion of the compound in which the oxyalkylene group bonded to $R^3$—O— is an oxyethylene group be 75 mol % or more and even 80 mol % or more (the upper limit is 100 mol % or less) in the compounds constituting the component (d). Such a compound can be obtained by first adding ethylene oxide to a fatty alcohol and then removing the unreacted alcohol or by first adding ethylene oxide at 6 moles or more and preferably 8 moles or more. Examples of such a compound include a compound in which the average added mole number represented by n1 in Formula (3-1-2) above or n11 in Formula (3-1-4) or (3-1-5) above is 6 moles or more and preferably 8 moles or more.

Such a compound can be obtained by finally adding only ethylene oxide at 6 moles or more and preferably 8 moles or more after completing the addition reaction process of an alkylene oxide having 3 or more and 5 or less carbon atoms and preferably propylene oxide to be the origin of $A^{21}O$ upon preparing a compound of Formula (3-1). For example, it is a compound in which the average added mole number represented by n12 in Formula (3-1-5) above is 6 moles or more and preferably 8 moles or more.

In the case of blending the component (d), the mass ratio of the blending amount of the component (b) to the total of the blending amount of the component (a) and the blending amount of the component (d) is preferably 0.4 or more, more preferably 0.5 or more, more preferably 0.65 or more and more preferably 0.75 or more by component (b)/[component (a)+component (d)] from the viewpoint that it is possible to improve washing performance for spilled food stains. The mass ratio is preferably 3 or less, more preferably 2.5 or less, more preferably 2 or less and more preferably 1.5 or less from the viewpoint of solubility in water.

In the case of blending the component (d), the mass ratio of the blending amount of the component (a) to the blending amount of the component (d) is preferably 0.2 or more, preferably 0.3 or more, more preferably 0.4 or more, more preferably 0.5 or more and more preferably 1.0 or more by component (a)/component (d) from the viewpoint of washing performance for spilled food stains. The mass ratio is preferably 3 or less, more preferably 2.5 or less, more preferably 2 or less and more preferably 1.5 or less from the viewpoint of washing performance for sebum stains.

In the case of blending the component (d), the mass ratio of the blending amount of the component (c) to the blending amount of the component (a), the blending amount of the component (b) and the blending amount of the component (d) is preferably 0.07 or more, more preferably 0.1 or more and more preferably 0.15 or more by component (c)/[component (a)+component (b)+component (d)] from the viewpoint that it is possible to improve the washing speed. The mass ratio is preferably 3 or less, more preferably 2 or less, more preferably 1 or less and more preferably 0.5 or less from the viewpoint of economic efficiency.

In the liquid detergent composition for clothing of the invention, a surfactant [hereinafter, referred to as the component (e)] other than the component (a), the component (b) and the component (d) may be blended.

As the component (e), an anionic surfactant [hereinafter, referred to as the component (e1)] may be mentioned. Examples of the component (e1) include an alkylbenzenesulfonic acid having an aliphatic alkyl group having 8 or more and 22 or less carbon atoms, a fatty acid having 8 or more and 22 or less carbon atoms, an alkanesulfonic acid in which the alkane has 8 or more and 20 or less carbon atoms, an alkyl sulfate ester and a polyoxyalkylene alkyl ether sulfate ester having an aliphatic alkyl group having 8 or more and 22 or less carbon atoms, and a salt thereof. Preferred examples of the component (e1) include an alkylbenzenesulfonic acid having an aliphatic alkyl group having 12 or more and 16 or less carbon atoms, a fatty acid having 12 or more and 18 or less carbon atoms, and a salt thereof. Examples of the salt of the component (e) include an alkali metal salt, an alkaline earth metal salt, an ammonium salt and an alkanolamine salt having 1 or more and 6 or less carbon atoms. As the salt, one or more kinds of salts selected from a sodium salt, a potassium salt, a monoethanolammonium salt and a triethanolammonium salt are preferable.

In addition, a cationic surfactant may be blended as the component (e). As the cationic surfactant, the compounds which are blended as an amine and can be converted into a cationic surfactant in water by the pH are also expressed as a cationic surfactant for the sake of convenience. Specifically, it is preferably one or more kinds of compounds selected from a tertiary amine salt having an aliphatic alkyl group having 11 or more and 22 or less carbon atoms, for example, an alkanoylaminopropyl-N,N-dimethylamine [alkanoyl refers to an aliphatic alkanoyl group having 11 or more and 21 or less carbon atoms] and a quaternary ammonium type surfactant having one or two aliphatic alkyl groups having 8 or more and 22 or less carbon atoms, for example, a N-alkyl-N,N,N-trimethylammonium chloride [alkyl refers to an aliphatic alkyl group having 10 or more and 18 or less carbon atoms], a N-alkyl-N,N-dimethyl-N-ethylammonium ethyl sulfate [alkyl refers to an aliphatic alkyl group having 10 or more and 18 or less carbon atoms] and a N,N-dialkyl-N,N-dimethylammonium chloride [alkyl refers to an aliphatic alkyl group having 8 or more and 12 or less carbon atoms].

In addition, an amphoteric surfactant may be blended as the component (e). Examples of the amphoteric surfactant include sulfobetaine or carboxybetaine having an alkyl group having 10 or more and 18 or less carbon atoms.

The blending amount of the component (e) is preferably 0.5% by mass or more and 15% by mass or less and more preferably 0.5% by mass or more and 10% by mass or less with respect to the total of the entire blended raw materials of the liquid detergent composition for clothing of the invention. In addition, for a quaternary ammonium salt, the mass excluding the counter anion thereof is adopted as the mass of the quaternary ammonium salt, and for a tertiary amine, the mass of the structure, wherein, of groups bonded to the nitrogen atom, groups other than an organic group are substituted by a hydrogen atom, is adopted as the mass of the tertiary amine. In the case of blending a cationic surfactant as the component (e), the blending amount thereof is preferably 5% by mass or less from the viewpoint of washing performance for sebum stains. To blend a cationic surfactant in an amount of 5% by mass or less means that it is not blended or it is blended in an amount of more than 0% by mass and 5% by mass or less. A cationic surfactant is blended in an amount of preferably 3% by mass or less and more preferably 1% by mass or less, and, more preferably, it is not blended.

In the liquid detergent composition for clothing of the invention, an alkali agent [hereinafter, referred to as the component (f)] is preferably blended from the viewpoint of detergency. Examples of the alkali agent include an alkanolamine in which one or more and three or less groups among the groups bonded to the nitrogen atom are an alkanol group having 2 or more and 4 or less carbon atoms and the other groups are an alkyl group having 1 or more and 4 or less carbon atoms or a hydrogen atom in addition to an alkali metal hydroxide and an alkali metal carbonate.

In the above, the alkanol group is preferably a hydroxyalkyl group, and further a hydroxyethyl group. The groups other than the alkanol group are preferably a hydrogen atom or a methyl group and more preferably a hydrogen atom. Examples of the alkanolamine include an alkanolamine such as 2-aminoethanol, N-methylethanolamine, N,N-dimethylethanolamine, N,N-diethylethanolamine, diethanolamine, N-methyldiethanolamine and triethanolamine. In the invention, as the component (f), an alkanolamine selected from monoethanolamine and triethanolamine is preferable and monoethanolamine is more preferable.

In addition, it is also possible to use the alkali agent of the component (f) in order to adjust the pH of the liquid detergent composition for clothing of the invention to a predetermined value.

In the liquid detergent composition for clothing of the invention, the component (f) may be blended in an amount so as to have a pH to be described below.

Specifically, the component (f) may be blended at 0.01% by mass or more and even 0.5% by mass or more, and 10% by mass or less and even 8% by mass or less. Among them, it is preferable to blend an alkanolamine as the component (f) at 0.5% by mass or more, even 1% by mass or more and even 3% by mass or more, and 8% by mass or less, even 7% by mass or less and even 6% by mass or less. Incidentally, in the invention, those that are derived from the other components such as the counter ion of the component (a) or the component (b) and blended in the composition should be counted in the blending amount of the alkali agent, especially the alkanolamine among them, of the component (f).

In the liquid detergent composition for clothing of the invention, a chelating agent [hereinafter, referred to as the component (g)] may be blended. Specific examples of the chelating agent of the component (g) include an aminopolyacetic acid such as ethylenediaminetetraacetic acid, diethylenetriaminepentaacetic acid and hydroxyethyliminodiacetic acid or a salt thereof, an organic acid such as citric acid, lactic acid, tartaric acid and malic acid or a salt thereof, 1-hydroxyethylidene-1,1-diphosphonic acid, diethylenetriaminepenta(methylene phosphonic acid) and an alkali metal salt thereof or a lower amine salt thereof. The blending amount of the component (g) is 0.1% by mass or more and 5% by mass or less, preferably 0.1% by mass or more and 4% by mass or less, more preferably 0.1 mass % or more and 3% by mass or less when it is regarded as an acid form.

In addition to this, in the liquid detergent composition for clothing of the invention, the following components (h1) to (h6) may be blended:

(h1) an antiredeposition agent such as polyacrylic acid, polymaleic acid and carboxymethyl cellulose and a dispersant at 0.01% by mass or more and 10% by mass or less (h2) a bleaching agent such as hydrogen peroxide, sodium percarbonate or sodium perborate at 0.01% by mass or more and 10% by mass or less;

(h3) a bleaching activator such as tetraacetylethylenediamine and a bleaching activator represented by Formulas (I-2) to (I-7) in JP-A 6-316700 at 0.01% by mass or more and 10% by mass or less;

(h4) one or more kinds of enzymes selected from cellulase, amylase, pectinase, protease and lipase and preferably one or more kinds of enzymes selected from amylase and protease at 0.001% by mass or more, preferably 0.01% by mass or more, more preferably 0.1% by mass or more and more preferably 0.3% by mass or more and 2% by mass or less and preferably 1% by mass or less. As the component (h4), an enzyme including amylase is preferable from the viewpoint of obtaining a faster washing speed. An enzyme including amylase and protease is preferable from the viewpoint of obtaining enhanced washability for the stains generated by the attachment of spilled food stains such as meat sauce to clothing to which sebum stains are attached;

(h5) a fluorescent dye, for example, a commercially available fluorescent dye such as Tinopal CBS (trade name, manufactured by BASF) and Whitex SA (trade name, manufactured by Sumitomo Chemical Co., Ltd.) at 0.001% by mass or more and 1% by mass or less;

(h6) an antioxidant such as butyl hydroxytoluene, distyrenated cresol, sodium sulfite and sodium bisulfite at 0.01% by mass or more and 2% by mass or less; and (h7) a dye, a perfume, an antimicrobial antiseptic, an antifoaming agent such as silicone in a suitable amount.

The pH of the liquid detergent composition for clothing of the invention at 20° C. is preferably 6 or more, even preferably 6.5 or more and even preferably 7 or more, and 11 or less, even preferably 9 or less and even preferably 8 or less from the viewpoint of obtaining an excellent detergency. The pH is measured by the method described in section 8.3 of JIS K3362: 1998 and the measurement temperature at that time is 20° C. as described therein. The pH measured by the above method is preferably 6 or more and 9 or less and more preferably 6.5 or more and 8 or less from the viewpoint of washing performance and ease of handling of the liquid detergent composition for clothing of the invention.

The viscosity of the liquid detergent composition for clothing of the invention at 20° C. is preferably 10 mPa·s or more, even more preferably 50 mPa·s or more and even more preferably 100 mPa·s or more, and preferably 500 mPa·s or less, even more preferably 400 mPa·s or less and even more preferably 300 mPa·s or less from the viewpoint of ease of handling. It is preferable that the viscosity be adjusted by the component (c) so as to be in this range. The viscosity in the invention is measured by a B-type viscometer. The rotor is selected depending on the viscosity. The viscosity after 60 seconds from the start of rotation at a rotation number of 60 r/min is adopted as the viscosity of the liquid detergent composition or the diluted solution. The measurement temperature (liquid temperature) for viscosity is selected depending on the respective purposes.

The viscosity of the liquid detergent composition for clothing of the invention at 20° C. is preferably 500 mPa·s or less and more preferably 400 mPa·s or less from the viewpoint that it is possible to improve the washing speed even when the ratio of the quantity of the washing liquid containing the liquid detergent composition for clothing of the invention (L) to the mass of clothing (kg), namely the ratio of [quantity of washing liquid (L)]/[mass of clothing (kg)] is as small as to be 3 or more and 20 or less, and even 3 or more and 15 or less.

According to the invention, a method for producing a liquid detergent composition for clothing is provided which includes mixing the following component (a), component (b) and component (c) and water and in which the component (a) and the component (b) are used in an amount in which the total of the blending amount of the component (a) and the blending amount of the component (b) is 15% by mass or more and 70% by mass or less with respect to the total mass of the entire blended raw materials and at a mass ratio to be the component (b)/component (a)=0.5 or more and 7 or less. Among the matters described in the liquid detergent composition for clothing, those applicable in this production method can be appropriately applied. The component (d) may be further mixed upon producing the liquid detergent composition for clothing described above.

Component (a): a nonionic surfactant represented by the following Formula (1):

$$R^1O\text{-}(EO)_mH \quad (1)$$

[in Formula (1), $R^1$ represents a hydrocarbon group having 8 or more and 18 or less carbon atoms, EO represents an ethyleneoxy group, and m represents an average added mole number and m is a number of 1 or more and 10 or less.]

Component (b): an anionic surfactant represented by the following Formula (2):

$$R^2O\text{-}[(A^1O)_p/(EO)_q]\text{—}SO_3M \quad (2)$$

[in Formula (2), $R^2$ represents a hydrocarbon group having 8 or more and 22 or less carbon atoms, $A^1O$ represents an alkyleneoxy group selected from an alkyleneoxy group having 3 carbon atoms and an alkyleneoxy group having 4 carbon atoms, EO represents an ethyleneoxy group, and p and q each represent an average added mole number, p is a number of 1 or more and 5 or less and q is a number of 0 to 10, the notation "/" indicates that the $(A^1O)_p$ group and the $(EO)_q$ group are bonded to each other in block in random order, and M represents a cation.]

Component (c): an organic solvent having one or more hydroxyl groups at 5% by mass or more and 40% by mass or less with respect to the total mass of the entire blended raw materials.

[Method for Washing Clothing]

The invention provides a method for washing clothing including washing clothing with a washing liquid containing water and the liquid detergent composition for clothing of the invention at 0.01% by mass or more and 0.1% by mass or less and having a temperature of 0° C. or higher and 35° C. or lower for 1 minute or longer and 7 minutes or shorter under a condition in which a bath ratio expressed by a ratio of an amount of the washing liquid (L) to a mass of clothing is amount of washing liquid (L)/mass of clothing (kg)=3 or more and 50 or less.

The washing liquid preferably contains the liquid detergent composition for clothing of the invention at 0.01% by mass or more and even more preferably 0.02% by mass or more, and 0.2% by mass or less and even more preferably 0.1% by mass or less. In addition, the washing liquid preferably contains the component (a) and the component (b) at 0.006% by mass or more and even more preferably 0.01% by mass or more, and 0.08% by mass or less and even more preferably 0.07% by mass or less in total.

Water used to prepare the washing liquid may be any water. Examples thereof include tap water, ion exchanged water, well water and river water. In addition, the hardness of water that is suitable for washing is 1° DH or more and 10° DH or less by Germany hardness.

The temperature of the washing liquid is preferably 0° C. or higher, more preferably 3° C. or higher and more preferably 5° C. or higher from the viewpoint of an improvement in washing speed. The temperature of the washing liquid is preferably 35° C. or lower, more preferably 30° C. or lower, more preferably 15° C. or lower and more preferably 10° C. or lower from the viewpoint of not removing the oil contained in the fiber itself constituting clothing too much and maintaining the texture of the fiber. In addition, upon washing in winter, it is possible to conduct the washing method which exhibits a fast washing speed for sebum stains and excellent detergency for spilled food stains even when washing clothing at a low washing liquid temperature of higher than 0° C. and 10° C. or lower and even higher than 3° C. and 8° C. or lower.

In recent years, the washing machine has been increased in size, and thus the value of bath ratio expressed by the ratio of the water amount of the washing liquid (L) to the mass of clothing, namely the value of water amount of the washing liquid (L)/mass of clothing (kg) (hereinafter, this ratio is referred to as the bath ratio in some cases) tends to decrease. It is said that the mechanical force by agitation is hardly transmitted to the clothing and thus detergency decreases as the bath ratio decreases in the case of using a washing machine for home use. The method for washing clothing of the invention can improve the washing speed even under a washing condition to have a small bath ratio. The bath ratio is preferably 4 or more and even more preferably 5 or more from the viewpoint of detergency. In addition, the bath ratio is preferably 45 or less, even more preferably 40 or less, even more preferably 30 or less, even more preferably 20 or less and more preferably 15 or less from the viewpoint of further obtaining the effect to improve the washing speed.

The description that "the effect to improve the washing speed is further obtained" means that the value of the "relative washing value (washing speed) of 5 min/10 min (1)" described in "(1-2) Evaluation on washing speed" or the "relative washing value of 5 min/10 min (2)" described in "(2-2) Evaluation on washing speed (2)" presented in the following Examples is closer to 1.

In the method for washing clothing of the invention, sufficient detergency can be obtained despite a short washing time. The washing time is 1 minute or longer, preferably 2 minutes or longer and more preferably 3 minutes or longer from the viewpoint of detergency. The washing time is 7 minutes or shorter and preferably 5 minutes or shorter from the viewpoint of further obtaining the effect to improve the washing speed.

The method for washing clothing of the invention provides the effect of the invention on an object not receiving an application of uniform mechanical force, such as clothing formed of fibers suitable for use of consumers, rather than a method of scouring fibers such as a method of immersing fibers in a liquid used for scouring while feeding them with a roller, etc. In addition, the washing method of the invention is suitable for a rotary type washing method. The rotary type washing method refers to a washing method in which the clothing that is not fixed to the rotary equipment rotates around the axis of rotation together with the washing liquid. The rotary type washing method can be conducted by a rotary type washing machine. Hence, in the invention, it is preferable to wash clothing using a rotary type washing machine. Specific examples of the rotary type washing machine include a drum type fully automatic washing machine, a pulsator type fully automatic washing machine or an agitator type fully automatic washing machine. As these rotary type washing machines, it is possible to use those which are for home use and commercially available for each.

The preferred method for washing clothing of the invention is a rotary type washing method using a rotary type washing machine and a washing method to agitate water to be used for washing, clothing and the liquid detergent composition for clothing of the invention in a rotary type washing machine from the viewpoint that an improvement in washing speed and the detergency for spilled food stains can be actually recognized. The rotary type washing machine is preferably a drum type fully automatic washing machine, a pulsator type fully automatic washing machine or an agitator type fully automatic washing machine, more preferably a pulsator type fully automatic washing machine or an agitator type fully automatic washing machine and even more preferably a pulsator type fully automatic washing machine. This method is a washing method in which the value of the bath ratio expressed by the ratio of the mass of clothing (kg) to the quantity of the washing liquid (L) prepared by mixing water to be used for washing with a detergent composition is preferably 5 or more, more preferably 10 or more and even preferably 20 or less and more preferably 15 or less by mass of clothing (kg)/quantity of washing liquid (L), a washing method in which the temperature of the washing liquid is higher than 0° C., preferably higher than 3° C., even more preferably 15° C. or lower and even more preferably 10° C. or lower. This method is a washing method in which a time from the start of agitating clothing, the detergent composition and water used for washing to the start of discharging a washing liquid from a washing machine is preferably 1 minute or longer, more preferably 2 minutes or longer and more preferably 3 minutes or longer and even preferably 7 minutes or shorter, more preferably 6 minutes or shorter and more preferably 5 minutes or shorter.

Consequently, examples of the method for washing clothing of the invention include a method for washing clothing in which clothing is washed with a washing liquid which contains water and the liquid detergent composition for clothing of the invention at 0.01% by mass or more and 0.1% by mass or less and has a temperature of higher than 0° C. and preferably higher than 3° C. and 15° C. or lower and preferably 10° C. or lower for 1 minute or longer, preferably 2 minutes or longer and more preferably 3 minutes or longer and 7 minutes or shorter, preferably 6 minutes or shorter and more preferably 5 minutes or shorter using a rotary type washing machine, preferably a drum type fully automatic washing machine, a pulsator type fully automatic washing machine or an agitator type fully automatic washing machine, more preferably a pulsator type fully automatic washing machine or an agitator type fully automatic washing machine and more preferably a pulsator type fully automatic washing machine under a condition in which a bath ratio expressed by the ratio of the quantity of the above washing liquid (L) to the mass of clothing is quantity of washing liquid (L)/mass of clothing (kg)=5 or more and preferably 10 or more and 20 or less and preferably 15 or less. As these rotary type washing machines, it is possible to use those which are for home use and commercially available for each.

The invention further discloses the following liquid detergent composition for clothing and method for washing clothing with regard to the embodiment described above.

<1>

A liquid detergent composition for clothing formed by blending the following component (a), component (b) and component (c) and water, in which a total of a blending amount of the component (a) and a blending amount of the component (b) is 15% by mass or more and 70% by mass or less with respect to a total mass of the entire blended raw materials; and a mass ratio of the blending amount of the component (b) to the blending amount of the component (a) is 0.5 or more and 7 or less by component (b)/component (a):

component (a): a nonionic surfactant represented by the following Formula (1):

$$R^1O\text{-}(EO)_mH \quad (1)$$

[in Formula (1), $R^1$ represents a hydrocarbon group having 8 or more, preferably 10 or more and more preferably 11 or more and 18 or less, preferably 16 or less and more preferably 14 or less carbon atoms, EO represents an ethyleneoxy group, and m represents an average added mole number and m is a number of 1 or more, preferably 2 or more, more preferably 2.5 or more and more preferably 3 or more and 10 or less, preferably 9 or less and more preferably 8 or less.];

component (b): an anionic surfactant represented by the following Formula (2):

$$R^2O\text{-}[(A^1O)_p/(EO)_q]\text{—}SO_3M \quad (2)$$

[in Formula (2), $R^2$ represents a hydrocarbon group having 8 or more, preferably 10 or more and more preferably 12 or more and 22 or less, preferably 16 or less and more preferably 14 or less carbon atoms, $A^2O$ represents an alkyleneoxy group selected from an alkyleneoxy group having 3 carbon atoms and an alkyleneoxy group having 4 carbon atoms, EO represents an ethyleneoxy group, and p and q each represent an average added mole number, p is a number of 1 or more and 5 or less and q is a number of 0 or more and 10 or less, the notation "/" indicates that the $(A^1O)_p$ group and the $(EO)_q$ group are bonded to each other in block in random order, and M represents a cation.]; and component (c): an organic solvent having one or more hydroxyl groups at 5% by mass or more, preferably 10% by mass or more and more preferably 13% by mass or more and 40% by mass or less, preferably 35% by mass or less and more preferably 25% by mass or less with respect to the total mass of the entire blended raw materials.

<2>

The liquid detergent composition for clothing according to <1>, in which the component (b) is an anionic surfactant selected from an anionic surfactant represented by the following Formula (2-1) and an anionic surfactant represented by the following Formula (2-2):

$$R^2O\text{-}(A^1O)_{p1}\text{-}(EO)_{q1}\text{—}SO_3M \quad (2\text{-}1)$$

[in Formula (2-1), $R^2$ represents a hydrocarbon group having 8 or more and 22 or less carbon atoms, $A^1O$ represents an alkyleneoxy group selected from an alkyleneoxy group having 3 carbon atoms and an alkyleneoxy group having 4 carbon atoms, EO represents an ethyleneoxy group, and p1 and q1 each represent an average added mole number, p1 is a number of 1 or more and 5 or less and q1 is a number of 0 or more and 10 or less, and M represents a cation.]; and $$R^2O\text{-}(EO)_{q2}\text{-}(A^1O)_{p2}\text{—}SO_3M \quad (2\text{-}2)$$

[in Formula (2-2), $R^2$ represents a hydrocarbon group having 8 or more and 22 or less carbon atoms, $A^1O$ represents an alkyleneoxy group selected from an alkyleneoxy group having 3 carbon atoms and an alkyleneoxy group having 4 carbon atoms, EO represents an ethyleneoxy group, and p2 and q2 each represent an average added mole number, p2 is a number of 1 or more and 5 or less and q2 is a number of 0.5 or more and 5 or less, and M represents a cation.]

<3>

The liquid detergent composition for clothing according to <2>, in which the component (b) is an anionic surfactant represented by Formula (2-1) above and p1 in Formula (2-1) above is a number of preferably 1.1 or more, more preferably 1.2 or more, more preferably 1.3 or more, more preferably 1.4 or more, more preferably 1.5 or more and more preferably 1.8 or more and preferably 4 or less, more preferably 3 or less, more preferably 3.0 or less, more preferably 2.9 or less, more preferably 2.8 or less and more preferably 2.5 or less.

<4>

The liquid detergent composition for clothing according to <2>, in which the component (b) is an anionic surfactant represented by Formula (2-2) above and p2 in Formula (2-2) above is a number of preferably 1.5 or more and more preferably 1.8 or more and preferably 4 or less, more preferably 3 or less and more preferably 2.5 or less.

<5>

The liquid detergent composition for clothing according to any of <1> to <4>, in which the total of the blending amount of the component (a) and the blending amount of the component (b) is preferably 20% by mass or more, more preferably 30% by mass or more and more preferably 40% by mass or more and preferably 70% by mass or less, more preferably 65% by mass or less and more preferably 60% by mass or less with respect to a total mass of the entire blended raw materials.

<6>

The liquid detergent composition for clothing according to any of <1> to <5>, of which the pH at 20° C. is preferably 6 or more, more preferably 6.5 or more and more preferably 7 or more and preferably 11 or less, more preferably 9 or less and more preferably 8 or less.

<7>

The liquid detergent composition for clothing according to any of <1> to <6>, in which the mass ratio of the blending amount of the component (b) to the blending amount of the component (a) is preferably 0.7 or more, more preferably 0.9 or more, more preferably 1.0 or more, more preferably 1.1 or more, more preferably 1.2 or more and more preferably 1.5 or more and preferably 6 or less, more preferably 5 or less, more preferably 4 or less, more preferably 3 or less, more preferably 2.5 or less, more preferably 2 or less and more preferably 1.8 or less by component (b)/component (a).

<8>

The liquid detergent composition for clothing according to any of <1> to <7>, in which the mass ratio of the blending amount of the component (a) to the blending amount of the component (c) is preferably 0.5 or more, more preferably 0.6 or more and more preferably 0.8 or more and preferably 2.5 or less, more preferably 2.4 or less, more preferably is 2.2 or less, more preferably 2.0 or less, more preferably 1.8 or less, more preferably 1.6 or less and more preferably 1.4 or less by component (a)/component (c).

<9>

The liquid detergent composition for clothing according to any of <1> to <8>, in which a proportion of a nonionic surfactant (a1) selected from a nonionic surfactant represented by Formula (1) in which $R^1$ is a branched primary hydrocarbon group and a nonionic surfactant represented by Formula (1) in which $R^1$ is a linear secondary hydrocarbon group in the component (a) is preferably 50% by mass or more, more preferably 70% by mass or more and more preferably 90% by mass or more.

<10>

The liquid detergent composition for clothing according to any of <1> to <9>, in which the component (a) is formed by blending the nonionic surfactant (a1) [hereinafter, referred to as the component (a1)] selected from a nonionic surfactant represented by Formula (1) in which $R^1$ is a branched primary hydrocarbon group and a nonionic surfactant represented by Formula (1) in which $R^1$ is a linear secondary hydrocarbon group and a nonionic surfactant (a2) [hereinafter, referred to as the component (a2)] represented by Formula (1) in which $R^1$ is a linear primary hydrocarbon group.

<11>

The liquid detergent composition for clothing according to <10>, in which the component (a) contains the component (a1) and the component (a2) and the blending ratio of the component (a1) to the component (a2) is preferably 0.5 or more, more preferably 0.7 or more, more preferably 0.9 or more and more preferably 1.0 or more and preferably 7 or less, more preferably 5 or less, more preferably 4 or less, more preferably 3 or less and more preferably 2 or less by a mass ratio of the component (a1)/component (a2).

<12>

The liquid detergent composition for clothing according to <10> or <11>, in which a total proportion of the component (a1) and the component (a2) in the component (a) is preferably 50% by mass or more, more preferably 70% by mass or more and more preferably 90% by mass or more.

<13>

The liquid detergent composition for clothing according to any of <10> to <12>, in which the component (a1) is a nonionic surfactant in which $R^1$ in Formula (1) is a linear secondary hydrocarbon group.

<14>

The liquid detergent composition for clothing according to any of <1> to <13>, in which the component (c) is one or more kinds selected from the following (c2) and (c4):

component (c2): a dihydric or higher and hexahydric or lower alcohol (excluding a polyalkylene glycol containing an alkylene glycol unit having 2 or more and 4 or less carbon atoms) having 2 or more and 6 or less carbon atoms; and component (c4): a monoalkyl ether of a (mono or poly) alkylene glycol having an alkylene glycol unit having 2 or more and 4 or less carbon atoms and an alkyl group having 1 or more and 4 or less carbon atoms.

<15>

The liquid detergent composition for clothing according to <14>, in which each of (c2) and (c4) is one or more kinds selected from the following compounds:

(c2) ethylene glycol, propylene glycol, butylene glycol, hexylene glycol, 1,5-pentanediol, 1,6-hexanediol and glycerol; and (c4) diethylene glycol monomethyl ether, triethylene glycol monomethyl ether, diethylene glycol monoethyl ether, dipropylene glycol monomethyl ether, dipropylene glycol monoethyl ether, tripropylene glycol monomethyl ether, diethylene glycol monobutyl ether, 1-methoxy-2-propanol and 1-ethoxy-2-propanol.

<16>

The liquid detergent composition for clothing according to any of <1> to <15>, which is formed by further blending the following component (d), in which a mass ratio of the blending amount of the component (b) to a total of the blending amount of the component (a) and a blending amount of the component (d), that is component (b)/[component (a)+component (d)], is 0.4 or more and 3 or less component (d): a nonionic surfactant represented by the following Formula (3):

$$R^3O\text{-}(A^2O)_nH \quad (3)$$

[in Formula (3), $R^3$ represents a hydrocarbon group having 8 or more and 22 or less carbon atoms, $A^2O$ represents an alkyleneoxy group having 2 or more and 5 or less carbon atoms, and n represents an average added mole number and is a number of 16 or more and 35 or less, and $A^2O$ contains an ethyleneoxy group having 2 carbon atoms at 16 moles or more on average, provided that when all of $A^2O$ are an ethyleneoxy group, n is a number of 18 or more.]

<17>

The liquid detergent composition for clothing according to <16>, in which the component (d) is a compound represented by the following Formula (3-1):

$$R^3O\text{—}[(C_2H_4O)_{n1}/(A^{21}O)_{n2}]\text{—}H \quad (3\text{-}1)$$

[in Formula (3-1), $R^3$ represents a hydrocarbon group having 8 or more and 22 or less carbon atoms, $A^{21}O$ represents an alkyleneoxy group having 3 or more and 5 or less carbon atoms; n1 and n2 each represent an average added mole number, n1 is a number of 15 or more and 30 or less, n2 is a number of 1 or more and 5 or less, and a total of n1 and n2 is a number of 16 to 35, the notation "/" indicates that the $C_2H_4O$ group and the $A^{21}O$ group may be bonded to each other in random or block, and in addition, $A^{21}O$ may be divided as a plurality of block bodies.]

<18>

The liquid detergent composition for clothing according to <16> or <17>, in which the component (d) is a compound represented by in Formula (3-1) above in which $R^3$ has preferably 10 or more, more preferably 12 or more and more preferably 14 or more and preferably 18 or less and more preferably 16 or less carbon atoms, $A^{21}O$ is an alkyleneoxy group selected from an alkyleneoxy group having 3 carbon atoms and an alkyleneoxy group having 4 carbon atoms and more preferably a copolymer of an alkyleneoxy having 3 carbon atoms, n1 is a number of preferably 16 or more and more preferably 18 or more and preferably 27 or less and more preferably 24 or less, n2 is a number of preferably 2 or more and preferably 4 or less and more preferably 3 or less, a total of n1 and n2 is preferably 17 or more, more preferably 18 or more and more preferably more than 18, and preferably 30 or less and more preferably 25 or less, and the $C_2H_4O$ group and the $A^{21}O$ group are preferably bonded to each other in block.

<19>

The liquid detergent composition for clothing according to any of <16> to <18>, in which the component (d) is one or more kinds of compounds selected from the following Formulas (3-1-1) to (3-1-5):

$$R^3O\text{-}(A^{21}O)_{n2}\text{—}(C_2H_4O)_{n1}\text{—}H \quad (3\text{-}1\text{-}1)$$

$$R^3O\text{—}(C_2H_4O)_{n1}\text{-}(A^{21}O)_{n2}\text{—}H \quad (3\text{-}1\text{-}2)$$

$$R^3O\text{—}[(C_2H_4O)_{n11}\cdot(A^{21}O)_{n2}]\text{—}(C_2H_4O)_{n12}\text{—}H \quad (3\text{-}1\text{-}3)$$

$$R^3O\text{—}(C_2H_4O)_{n11}\text{-}[(A^{21}O)_{n2}\cdot(C_2H_4O)_{n12}]\text{—}H \quad (3\text{-}1\text{-}4) \text{ and}$$

$$R^3O\text{—}(C_2H_4O)_{n11}\text{-}(A^{21}O)_{n2}\text{—}(C_2H_4O)_{n12}\text{—}H \quad (3\text{-}1\text{-}5)$$

[in Formulas, $R^3$ represents a hydrocarbon group having 8 or more and 22 or less carbon atoms, and is preferably a linear primary alkyl group, $A^{21}O$ represents an alkyleneoxy group having 3 or more and 5 or less carbon atoms. n1 and n2 each represent an average added mole number, n1 is a number of 15 or more and 30 or less and n2 is a number of 1 or more and 5 or less, and a total of n1 and n2 is a number of 16 or more and 35 or less; n11 and n12 each represent an average added mole number and n1=n11+n12, the notation "·" indicates that it is a random bond, and in addition, $A^{21}O$ may be divided as a plurality of block bodies.]

<20>

The liquid detergent composition for clothing according to <19>, in which the component (d) is preferably one or more kinds of compounds selected from Formulas (3-1-2), (3-1-4) and (3-1-5) above and more preferably one or more kinds of compounds selected from Formula (3-1-5) above.

<21>

The liquid detergent composition for clothing according to any of <16> to <20>, in which a mass ratio of the blending amount of the component (a) to the blending amount of the component (d) is preferably 0.2 or more, more preferably 0.3 or more, more preferably 0.4 or more, more preferably 0.5 or more and more preferably 1.0 or more, and preferably 3 or less, more preferably 2.5 or less, more preferably 2 or less and more preferably 1.5 or less by component (a)/component (d).

<22>

The liquid detergent composition for clothing according to any of <16> to <21>, in which a mass ratio of the blending amount of the component (b) to a total of the blending amount of the component (a) and the blending amount of the component (d) is preferably 0.4 or more, more preferably 0.5 or more, more preferably 0.65 or more and more preferably 0.75 or more, and preferably 3 or less, more preferably 2.5 or less, more preferably 2 or less and more preferably 1.5 or less by component (b)/[component (a)+component (d)].

<23>

The liquid detergent composition for clothing according to any of <1> to <22>, in which one or more kinds of enzymes selected from cellulase, amylase, pectinase, protease and lipase and preferably one or more kinds of enzymes selected from amylase and protease are blended at 0.001% by mass or more, preferably 0.01% by mass or more, more preferably 0.1% by mass or more and more preferably 0.3% by mass or more, and 2% by mass or less and preferably 1% by mass or less.

<24>

The liquid detergent composition for clothing according to any of <1> to <23>, in which the blending amount of a cationic surfactant is preferably 5% by mass or less, more preferably 4% by mass or less, more preferably 3% by mass or less, more preferably 2% by mass or less, more preferably 1.5% by mass or less, more preferably 1.0% by mass or less and more preferably 0.5% by mass or less, and more preferably a cationic surfactant is not blended.

<25>

A method for washing clothing including washing clothing with a washing liquid containing water and the liquid detergent composition for clothing according to any of <1> to <24> at 0.01% by mass or more and preferably 0.02% by mass or more and 0.2% by mass or less and preferably 0.1% by mass or less and having a temperature of 0° C. or higher, preferably higher than 0° C. and more preferably 3° C. or higher and 35° C. or lower, preferably 30° C. or lower, more preferably 15° C. or lower and preferably 10° C. or lower for 1 minute or longer, preferably 2 minutes or longer and more preferably 3 minutes or longer and 7 minutes or shorter and preferably 5 minutes or shorter under a condition in which a bath ratio expressed by a ratio of an amount of the washing liquid (L) to a mass of clothing is amount of washing liquid (L)/mass of clothing (kg)=3 or more, preferably 4 or more and more preferably 5 or more and 50 or less, preferably 40 or less, more preferably 30 or less, more preferably 20 or less and more preferably 15 or less.

<26>

The method for washing clothing according to <25>, in which clothing is washed for 3 minutes or longer and 7 minutes or shorter.

<27>

The method for washing clothing according to <25> or <26>, in which the bath ratio expressed by the ratio of the amount of the washing liquid (L) to the mass of clothing is amount of washing liquid (L)/mass of clothing (kg)=5 or more and 20 or less.

<28>

The method for washing clothing according to any of <25> to <27>, in which the liquid detergent composition for clothing is contained in the washing liquid at 0.02% by mass or more and 0.1% by mass or less.

<29>

The method for washing clothing according to any of <25> to <28>, in which washing of clothing is performed using a rotary type washing machine.

<30>

The method for washing clothing according to <29>, in which the rotary type washing machine is a drum type fully automatic washing machine, a pulsator type fully automatic washing machine or an agitator type fully automatic washing machine, preferably a pulsator type fully automatic washing machine or an agitator type fully automatic washing machine and more preferably a pulsator type fully automatic washing machine.

EXAMPLES

The following Examples illustrate the implementation of the invention. Examples are intended to illustrate the invention but are not intended to limit the same.

In order to demonstrate the effect of the invention, Terg-O-Tometer (Ueshima, MS-8212) was used as a washing device. Terg-O-Tometer (Ueshima, MS-8212) is a rotary type device that performs washing and is generally used as a model washing device of a drum type fully automatic washing machine for home use, a pulsator type fully automatic washing machine for home use or an agitator type fully automatic washing machine for home use. Especially, it is a model washing device corresponding to the pulsator type fully automatic washing machine for home use or the agitator type fully automatic washing machine for home use.

Examples 1-1 to 1-9 and Comparative Examples 1-1 to 1-5

The compositions of Examples and Comparative Examples were obtained by mixing the components presented in Table 1.

In a 300-ml glass beaker, a stirrer piece (made of Teflon (registered trademark)) with a diameter of 60 mm was placed and the component (a), the component (b) or the component (b'), the component (c) and the required amount of 95% by mass water (water containing sodium hypochlorite at 3 mg/kg) were fed so as to have the obtained mass of 200 g and the blending amounts presented in Table 1. After being fed, the mixture was stirred for 20 minutes at a rotation number of 100 rotation/min. Thereafter, the component (d) and the component (e) were fed therein if necessary, the pH of the composition was adjusted to the pH presented in Table 1 with the component (f), and the mass thereof was adjusted to the finally obtained mass (200 g) using remaining water, thereby obtaining the liquid detergent compositions for clothing presented in Table 1. Incidentally, in Example 1-9, the following other components were added at the time of adding the component (d). The pH was measured by the method described in section 8.3 of JIS K3362: 1998 (temperature of composition at the time of measurement: 20° C.). The pH presented in Table 1 represents the value obtained by measuring the pH of the finally obtained composition again. Each of the compositions thus obtained was subjected to the following respective evaluations. The results are presented in Table 1. The components in Table are as follows.

Component (a)

(a-1): a compound obtained by adding ethylene oxide to a secondary alcohol having 12 to 14 carbon atoms at 7 moles on average [SOFTANOL 70 (trade name) manufactured by NIPPON SHOKUBAI CO., LTD., a compound represented by Formula (1) in which $R^1$ is a secondary alkyl group having 12 to 14 carbon atoms and m is 7.]

(a-2): a compound obtained by adding ethylene oxide to a linear primary alcohol having 12 carbon atoms at 4 moles on average [a compound in which $R^1$ in Formula (1) is a linear primary alkyl group having 12 carbon atoms and m is 4]

(a-3): a compound obtained by adding ethylene oxide to a linear primary alcohol having 12 carbon atoms at 6 moles on average [a compound in which $R^1$ in Formula (1) is a linear primary alkyl group having 12 carbon atoms and m is 6]

Component (b)

(b-1): an anionic surfactant produced by the following production method (b1) [the blending amount in Table is the blending amount of the acid form corresponding to the component (b) and monoethanolamine (the total amount used in this production method) of the counter salt was counted in the component (f)]

<Production Method (b1)>

In an autoclave equipped with a stirring device, a temperature control device and an automatic introduction device, 2340 g of a linear primary alcohol having 12 carbon atoms [trade name: KALCOL 2098 manufactured by Kao Corporation] and 3.5 g of KOH were fed and subjected to the dehydration for 30 minutes at 110° C. and 1.3 kPa. After the dehydration, the resultant was subjected to nitrogen substitution, the temperature thereof was raised to 120° C., and then 1460 g of propane-1,2-diyl oxide (hereinafter, referred to as "PO") was fed therein. The mixture was subjected to the addition reaction and aging at 120° C. and then cooled to 80° C., the unreacted PO was removed therefrom at 4.0 kPa, then 3.8 g of acetic acid was added into the autoclave, followed by stirring for 30 minutes at 80° C., and then the extraction thereof was performed, thereby obtaining an alkoxylate having an average PO added mole number of 2.0.

The alkoxylate thus obtained was sulfated by a falling thin-film type reactor using $SO_3$ gas. The sulfated product thus obtained was neutralized with monoethanolamine to obtain a composition containing a polyoxypropylene alkyl ether sulfate ester salt [(b-1)].

(b-1) thus obtained is a compound represented by Formula (2-1) in which $R^2$ is a linear primary alkyl group having 12 carbon atoms, $A^1O$ is a propyleneoxy group, M is a monoethanolammonium, p1 is 2.0 on average and q1 is 0. In addition, the results of the gas chromatographic analysis and NMR analysis reveal that the composition thus obtained contains the compound represented by Formula (2-1) at 98% by mass.

(b-2): an anionic surfactant produced by the following production method (b2) [the blending amount in Table is the blending amount of the acid form corresponding to the component (b) and monoethanolamine (the total amount used in this production method) of the counter salt was counted in the component (f)]

<Production Method (b2)>

In an autoclave equipped with a stirring device, a temperature control device and an automatic introduction device, 2340 g of a linear primary alcohol having 12 carbon atoms [trade name: KALCOL 2098 manufactured by Kao Corporation] and 3.5 g of KOH were fed and subjected to the dehydration for 30 minutes at 110° C. and 1.3 kPa. After the dehydration, the resultant was subjected to nitrogen substitution, the temperature thereof was raised to 120° C., and then 2190 g of PO was fed therein. The mixture was subjected to the addition reaction and aging at 120° C., then cooled to 80° C., the unreacted PO was removed therefrom at 4.0 kPa, then 3.8 g of acetic acid was added into the autoclave, followed by stirring for 30 minutes at 80° C., and then the extraction thereof was performed, thereby obtaining an alkoxylate having an average PO added mole number of 3.0.

The alkoxylate thus obtained was sulfated in the same manner as in the production method (b1), thereby obtaining a composition containing a polyoxypropylene alkyl ether sulfate ester salt [(b-2)].

(b-2) thus obtained is a compound represented by Formula (2-1) in which $R^2$ is a linear primary alkyl group having 12 carbon atoms, $A^1O$ is a propyleneoxy group, M is a monoethanolammonium, p1 is 3.0 on average and q1 is 0. In addition, the results of the gas chromatographic analysis and NMR analysis reveal that the composition thus obtained contains the compound represented by Formula (2-1) at 98% by mass.

(b-3): an anionic surfactant produced by the following production method (b3) [the blending amount in Table is the blending amount of the acid form corresponding to the component (b) and monoethanolamine (the total amount used in this production method) of the counter salt was counted in the component (f)]

<Production Method (b3)>

The dehydration of a linear primary alcohol having 12 carbon atoms [trade name: KALCOL 2098] was conducted in the same manner as in the production method (b1). After the dehydration, the resultant was subjected to nitrogen substitution, the temperature thereof was raised to 120° C., and then 730 g of PO was fed therein. The mixture was subjected to the addition reaction and aging at 120° C., then the temperature thereof was raised to 145° C., 1107 g of ethylene oxide (hereinafter, referred to as "EO") was fed therein. The mixture was subjected to the addition reaction and aging at 145° C. and then cooled to 80° C., and the unreacted EO was removed therefrom at 4.0 kPa. After removing the unreacted EO, 3.8 g of acetic acid was added into the autoclave, followed by stirring for 30 minutes at 80° C., and then the extraction thereof was performed, thereby obtaining an alkoxylate having an average PO added mole number of 1.0 and an average EO added mole number of 2.0.

The alkoxylate thus obtained was sulfated in the same manner as in the production method (b1) and then neutralized, thereby obtaining a composition containing an alkyl ether sulfate ester salt [(b-3)].

The results of the gas chromatographic analysis and NMR analysis reveal that (b-3) thus obtained is a compound represented by Formula (2-1) in which $R^2$ is a linear primary alkyl group having 12 carbon atoms, $A^1O$ is a propyleneoxy group, M is a monoethanolammonium, p1 is 1.0 on average and q1 is 2.0 on average. In addition, the results of the gas chromatographic analysis and NMR analysis reveal that the composition thus obtained contains the compound represented by Formula (2-1) at 80% by mass.

(b-4): an anionic surfactant produced by the following production method (b4) [the blending amount in Table is the blending amount of the acid form corresponding to the component (b) and monoethanolamine (the total amount used in this production method) of the counter salt was counted in the component (f)]

<Production Method (b4)>

The dehydration of a linear primary alcohol having 12 and 14 carbon atoms [trade name: KALCOL 2470] was conducted in the same manner as in the production method (b1). After the dehydration, the resultant was subjected to nitrogen substitution, the temperature thereof was raised to 120° C., and then 1460 g of PO was fed therein. The mixture was subjected to the addition reaction and aging at 120° C., then the temperature thereof was raised to 145° C., 1107 g of EO was fed therein. The mixture was subjected to the addition reaction and aging at 145° C. and then cooled to 80° C., and the unreacted EO was removed therefrom at 4.0 kPa. After removing the unreacted EO, 3.8 g of acetic acid was added into the autoclave, followed by stirring for 30 minutes at 80° C., and then the extraction thereof was performed, thereby obtaining an alkoxylate having an average PO added mole number of 2.0 and an average EO added mole number of 2.0.

The alkoxylate thus obtained was sulfated in the same manner as in the production method (b1) and then neutralized, thereby obtaining a composition containing an alkyl ether sulfate ester salt [(b-4)].

The results of the gas chromatographic analysis and NMR analysis reveal that (b-4) thus obtained is a compound represented by Formula (2-1) in which $R^2$ is a linear primary alkyl group having 12 and 14 carbon atoms, $A^1O$ is a propyleneoxy group, M is a monoethanolammonium, p1 is 2.0 on average and q1 is 2.0 on average. In addition, the results of the gas chromatographic analysis and NMR analysis reveal that the composition thus obtained contains the compound represented by Formula (2-1) at 80% by mass.

Component (b'): a comparative compound of the component (b)

(b'-1): a compound represented by Formula (2-1) in which $R^2$ is a linear primary alkyl group having 12 and 14 carbon atoms, $A^1O$ is a propyleneoxy group, M is a monoethanolammonium, p1 is 0 and q1 is 2.0 on average Component (c)

(c-1): diethylene glycol monobutyl ether (c-2): propylene glycol (c-3): 1,6-hexanediol Component (d)

(d−1): a product obtained by addition reaction with 9 moles of ethylene oxide, 2 moles of propylene oxide and 9 moles of ethylene oxide in this order per one mole of coconut oil-derived primary linear alcohol having 10-14 carbon atoms [a compound represented by Formula $R^3O$-$(EO)_{n11}$-$(A^2O)_{n2}$-$(EO)_{n12}H$ in which $R^3$ is a linear alkyl group having 10 to 14 carbon atoms, $A^2O$ is an oxypropylene group, n11 is 9 on average, n2 is 2 on average and n12 is 9 on average]

Component (e)

(e-1): an alkylbenzenesulfonic acid having a linear alkyl group having 10 to 14 carbon atoms (e-2): LUNAC L-55 (trade name) (coconut oil-based fatty acid; manufactured by Kao Corporation)

Component (f)

(f-1): monoethanolamine (including the blending amount as the counter ion of component (b))

<Other Components>

Polymer (1): a polymer compound synthesized by the method of Synthesis Example 1 described in paragraph 0020 of JP-A 10-60476.

Fluorescent dye: Tinopal CBS-X (trade name) (manufactured by BASF)

Enzyme (1): Everlase 16.0L-EX (trade name) (protease, manufactured by Novozymes)

Enzyme (2): Stainzyme (trade name) (amylase, manufactured by Novozymes)

Dye (1): Green No. 202

Dye (2): Yellow No. 203

(1) Evaluation on Detergency

<Preparation of Stained Cloth for Evaluation>

Preparation of Cloth Artificially Stained with Model Sebum

The cloth artificially stained with model sebum was prepared by attaching an artificial staining liquid of model sebum having the following composition to a cloth. The attachment of the artificial staining liquid of model sebum to the cloth was carried out by printing the artificial staining liquid on the cloth using a gravure roll coater. The process of preparing the cloth artificially stained with model sebum by attaching the artificial staining liquid of model sebum to the cloth was performed at a cell volume of gravure roll of 58 $cm^3/m^2$, a coating speed of 1.0 m/min, a drying temperature of 100° C. and a drying time of 1 minute. Cotton 2003 (manufactured by TANIGASHIRA SHOTEN) was used as the cloth.

*Composition of Artificial Staining Liquid of Model Sebum:

0.4% by mass of lauric acid, 3.1% by mass of myristic acid, 2.3% by mass of pentadecanoic acid, 6.2% by mass of palmitic acid, 0.4% by mass of heptadecanoic acid, 1.6% by mass of stearic acid, 7.8% by mass of oleic acid, 13.0% by mass of triolein, 2.2% by mass of n-hexadecyl palmitate, 6.5% by mass of squalene, 1.9% by mass of egg white lecithin liquid crystal material, 8.1% by mass of Kanuma red soil, 0.01% by mass of carbon black and water as the balance (total 100% by mass)

Preparation of Cloth Stained with Meat Sauce 0.15 g of a commercially available retort meat sauce (Ma•Ma meat sauce (canned) manufactured by Nisshin Foods Inc., purchased July, 2012) was applied to cotton knitted cloth (manufactured by TANIGASHIRA SHOTEN), uniformly spread, dried for 12 hours at room temperature, and then subjected to the test.

<Washing Evaluation Method (1)>

(1-1) Evaluation on Detergency

Each of the 5 sheets of cloth stained with meat sauce (6 cm×6 cm) thus prepared was directly applied with 67 μL of the liquid detergent composition, then allowed to stand for 5 minutes in that state, and placed in 1 L of tap water to be washed using Terg-O-Tometer (Ueshima, MS-8212) at 85 rpm. The washing conditions were as follows. The washing time was 10 minutes, the concentration of the detergent composition at the time of washing was 0.033% by mass, the water temperature was 20° C., and the bath ratio was 20 (adjusted with the cloth obtained by cutting cotton 2003 (manufactured by TANIGASHIRA SHOTEN) into 6 cm×6 cm). After washing, rinsing was performed for 3 minutes with tap water (20° C.)

The reflectivity of the original cloth before staining and the cloth before and after washing at 550 nm was measured by a colorimetric color difference meter (Z-300A manufactured by NIPPON DENSHOKU INDUSTRIES Co., LTD.), and the washed rate (%) was determined by the following Equation (washed rate is the average value of the washed rates of 5 sheets).

Washed rate (%)=100×[(reflectivity after washing−reflectivity before washing)/(reflectivity of original cloth−reflectivity before washing)

The relative washing value (1) was determined by the following Equation while the washing rate (%) (expressed as a numerical value in parentheses in the Table) of the composition of Comparative Example 1-3 was used as a reference. The results are presented in Table.

Relative washing value (1)=[washed rate (%) of Example or Comparative Example to be compared]−[washed ratio (%) of Comparative Example 1-3 (reference composition)]

It indicates that detergency is higher as the relative washing value (1) is greater. A significant difference is acknowledged when the difference in the relative washing value (1) is 3 or more.

(1-2) Evaluation on Washing Speed (1)

The 5 sheets of cloth artificially stained with model sebum (6 cm×6 cm) thus prepared were washed using Terg-O-Tometer (Ueshima, MS-8212) for 5 minutes or 10 minutes at 85 rpm. The washing conditions were as follows. The concentration of the liquid detergent composition was 0.033% by mass, the water temperature was 20° C., and the bath ratio was 20 (adjusted with the cloth obtained by cutting cotton 2003 (manufactured by TANIGASHIRA SHOTEN) into 6 cm×6 cm). After washing, rinsing was performed for 3 minutes with tap water (20° C.). The washed rate was measured by the method described in (1-1) above and the average value of the 5 sheets was determined. The relative washing value of 5 min/10 min (1) was determined from each washed rate (average value) for the 5 minutes and 10 minutes of washing time by the following Equation. The results are presented in Table. Incidentally, in Table, the washed rate (average value) for the 5 minutes of washing time in this evaluation on washing speed (1) is also represented as the "washed rate after 5 minutes (1)".

Relative washing value of 5 min/10 min (1) (washing speed)=washed rate (%) for 5 minutes of washing time/washed rate (%) for 10 minutes of washing time

TABLE 1

| | | | | Examples | | | | | | | | | Comparative examples | | | | |
|---|---|---|---|---|---|---|---|---|---|---|---|---|---|---|---|---|---|
| | | | | 1-1 | 1-2 | 1-3 | 1-4 | 1-5 | 1-6 | 1-7 | 1-8 | 1-9 | 1-1 | 1-2 | 1-3 | 1-4 | 1-5 |
| Liquid detergent composition for clothing | Blending amount (% by mass) | (a) | (a-1) | 30.0 | 40.0 | 20.0 | 30.0 | 30.0 | 20.0 | 10.0 | 10.0 | 10.0 | 50.0 | 30.0 | | | 40.0 |
| | | | (a-2) | | | | | | | | 3.0 | 3.0 | | | | | |
| | | | (a-3) | | | | | | | 10.0 | 10.0 | 10.0 | | | | | |
| | | | (a-4) | | | | | | | | | | | | | | |
| | | (b) | (b-1) | | | | 30.0 | | | | | | | | | | |
| | | | (b-2) | | | | | 30.0 | | | | | | | | | |
| | | | (b-3) | | | | | | | | 30.0 | | | | | 15.0 | |
| | | | (b-4) | 30.0 | 20.0 | 30.0 | | | 40.0 | 30.0 | | 28.0 | 10.0 | 30.0 | 20.0 | | |
| | | (b ' ) | (b '-1) | | | | | | | | | | | | | | 20.0 |
| | | (c) | (c-1) | 16.0 | 16.0 | 16.0 | 20.0 | 20.0 | | 17.0 | 16.0 | 16.0 | 16.0 | 1.0 | 16.0 | 15.0 | 16.0 |
| | | | (c-2) | | | | | | | | | 3.0 | | | | | |
| | | | (c-3) | | | | | | 20.0 | | | | | | | | |
| | | (d) | (d-1) | | | 10.0 | | | | 10.0 | 10.0 | 10.0 | | | 40.0 | 50.0 | |
| | | (e) | (e-1) | | | | | | | | | 1.0 | | | | | |
| | | | (e-2) | 3.2 | 3.2 | 3.2 | 3.2 | 3.2 | 3.2 | 3.2 | 3.2 | 3.2 | 3.2 | 3.2 | 3.2 | 3.2 | 3.2 |
| | | (f) | (f-1) | 4.0 | 4.0 | 4.0 | 4.0 | 4.0 | 5.3 | 4.0 | 4.0 | 4.0 | 4.0 | 4.0 | 4.0 | 4.0 | 4.0 |
| | | Polymer (1) | | | | | | | | | | 3.0 | | | | | |
| | | Fluorescence dye | | | | | | | | | | 0.2 | | | | | |
| | | Enzyme (1) | | | | | | | | | | 0.5 | | | | | |
| | | Enzyme (2) | | | | | | | | | | 0.3 | | | | | |
| | | Dye (1) | | | | | | | | | | 0.0005 | | | | | |
| | | Dye (2) | | | | | | | | | | 0.0003 | | | | | |
| | | Perfume | | | | | | | | | | 1.0 | | | | | |
| | | Water | | Balance | Balance | Balance | Balance | Balance | Balance | Balance | Balance | Balance | Balance | Balance | Balance | Balance | Balance |
| | | Total | | 100 | 100 | 100 | 100 | 100 | 100 | 100 | 100 | 100 | 100 | 100 | 100 | 100 | 100 |
| | | pH(20° C.) | | 8.5 | 8.5 | 8.5 | 8.5 | 8.5 | 8.5 | 8.5 | 8.5 | 8.5 | 8.5 | 8.5 | 8.5 | 8.5 | 8.5 |
| | | (b)/(a) (mass ratio) | | 1.0 | 0.50 | 1.5 | 1.0 | 1.0 | 2.0 | 1.5 | 1.3 | 1.5 | 0.20 | 1.0 | — | — | — |
| | | (a) + (b) (% by mass) | | 60.0 | 60.0 | 50.0 | 60.0 | 60.0 | 60.0 | 50.0 | 53.0 | 58.0 | 60.0 | 60.0 | 20.0 | 15.0 | 40.0 |
| | | (a)/(c) (Mass ratio) | | 1.9 | 2.5 | 1.3 | 1.5 | 1.5 | 1.0 | 1.2 | 1.4 | 1.2 | 3.1 | 30 | — | — | — |
| | | (b)/[(a) + (d)] (Mass ratio) | | 1.0 | 0.50 | 1.0 | 1.0 | 1.0 | 2.0 | 1.0 | 0.91 | 1.1 | 0.20 | 1.0 | 0.50 | 0.30 | — |
| | | (c)/[(a) + (b)] (Mass ratio) | | 0.27 | 0.27 | 0.32 | 0.33 | 0.33 | 0.33 | 0.34 | 0.30 | 0.33 | 0.27 | 0.017 | 0.80 | 1.0 | 0.4 |
| Detergency | | Relative washing value (1) | | +45 | +45 | +43 | +41 | +41 | +43 | +41 | +42 | +47 | +30 | −5 | Reference (43) | −3 | +20 |
| Washing speed | | Relative washing value of 5 min/10 min (1) | | 0.90 | 0.82 | 0.95 | 0.82 | 0.81 | 0.88 | 0.90 | 0.92 | 0.90 | 0.63 | 0.55 | 0.75 | 0.72 | 0.75 |
| | | Washed rate after 5 minutes (1) | | 36 | 37 | 41 | 36 | 36 | 45 | 40 | 40 | 40 | 19 | 14 | 30 | 29 | 22 |

Examples 1-10 to 1-27 and Comparative Examples 1-6 and 1-7

The liquid detergent compositions for clothing presented in Table 2 were prepared in the same manner as in Example 1-1 and the like by mixing the components presented in Table 2, and the detergency and the washing speed were evaluated by the following "Washing evaluation method (2)". The results are presented in Table 2.

Comparative Example 1-6 has a composition close to Example 10 of JP-A 2011-208130.

<Washing Evaluation Method (2)>

(2-1) Evaluation on Detergency

The evaluation on detergency was performed by the same evaluation method as "(1-1) Evaluation on detergency" described in Example 1-1 and the like except that Comparative Example 1-6 was taken as the reference instead of Comparative Example 1-3. The evaluation result herein was denoted as the "relative washing value (2)".

(2-2) Evaluation on Washing Speed (2)

The 5 sheets of cloth artificially stained with model sebum (6 cm×6 cm) prepared in Example 1-1 and the like were washed using Terg-O-Tometer (Ueshima, MS-8212) for 5 minutes or 10 minutes at 85 rpm. At that time, the liquid detergent composition and the cloth artificially soiled with model sebum were added to tap water (20° C.) and washed at the same time. The washing conditions were as follows. The concentration of the liquid detergent composition was 0.033% by mass, the water temperature was 20° C., and the bath ratio was 20 (adjusted with the cloth obtained by cutting cotton 2003 (manufactured by TANIGASHIRA SHOTEN) into 6 cm×6 cm). After washing, rinsing was performed for 3 minutes with tap water (20° C.). The washed rate was measured by the method described in (2-1) above and the average value of the 5 sheets was determined. The relative washing value of 5 min/10 min (2) was determined from each washed rate (average value) for the 5 minutes and 10 minutes of washing time by the following Equation. The results are presented in Table. Incidentally, in Table, the washed rate (average value) for the 5 minutes of washing time in this evaluation on washing speed (2) is also represented as the "washed rate after 5 minutes (2)".

Relative washing value of 5 min/10 min (2) (washing speed)=washed rate (%) for 5 minutes of washing time/washed rate (%) for 10 minutes of washing time

TABLE 2

| | | | | Examples | | | | | | | | | | | | | | | | | | Comparative examples | |
|---|---|---|---|---|---|---|---|---|---|---|---|---|---|---|---|---|---|---|---|---|---|---|---|
| | | | | 1-10 | 1-11 | 1-12 | 1-13 | 1-14 | 1-15 | 1-16 | 1-17 | 1-18 | 1-19 | 1-20 | 1-21 | 1-22 | 1-23 | 1-24 | 1-25 | 1-26 | 1-27 | 1-6 | 1-7 |
| Liquid detergent composition for clothing | Blending amount (% by mass) | (a) | (a-1) | 10.0 | 10.0 | 10.0 | 10.0 | 16.0 | 8.5 | | 1.0 | 5.0 | 15.0 | 19.0 | 7.5 | 12.0 | 15.0 | 10.0 | 10.0 | 10.0 | 10.0 | | 10.0 |
| | | | (a-2) | 6.0 | 6.0 | 6.0 | 6.0 | | 7.5 | 16.0 | 6.0 | 6.0 | 6.0 | 6.0 | 4.5 | 7.2 | 9.0 | 6.0 | 6.0 | 6.0 | 6.0 | | 6.0 |
| | | (b) | (b-4) | 25.0 | 25.0 | 25.0 | 25.0 | 25.0 | 25.0 | 25.0 | 34.0 | 30.0 | 20.0 | 16.0 | 25.0 | 25.0 | 25.0 | 25.0 | 25.0 | 25.0 | 25.0 | 25.0 | 25.0 |
| | | (c) | (c-1) | 25.0 | 20.0 | 17.0 | 10.0 | 10.0 | 10.0 | 10.0 | 17.0 | 17.0 | 17.0 | 17.0 | 17.0 | 17.0 | 17.0 | 17.0 | 17.0 | 17.0 | 17.0 | 17.0 | 3.0 |
| | | (d) | (d-1) | 13.0 | 13.0 | 13.0 | 13.0 | 13.0 | 13.0 | 13.0 | 13.0 | 13.0 | 13.0 | 13.0 | 17.0 | 9.8 | 5.0 | | 6.0 | 20.0 | 30.0 | 29.0 | 13.0 |
| | | (e) | (e-2) | 3.2 | | | | | | | | | | | | | | | | | | 3.2 | |
| | | (f) | (f-1) | Amount required to adjust pH to 7.5*1 | | | | | | | | | | | | | | | | | | Amount required to adjust pH to 7.5*1 | |
| | | Polymer (1) | | 3.0 | | | | | | | | | | | | | | | | | | 3.0 | |
| | | Fluorescence dye | | 0.2 | | | | | | | | | | | | | | | | | | 0.2 | |
| | | Enzyme (1) | | 0.5 | | | | | | | | | | | | | | | | | | 0.5 | |
| | | Enzyme (2) | | 0.3 | | | | | | | | | | | | | | | | | | 0.3 | |
| | | Dye (1) | | 0.0005 | | | | | | | | | | | | | | | | | | 0.0005 | |
| | | Dye (2) | | 0.0003 | | | | | | | | | | | | | | | | | | 0.0003 | |
| | | Perfume | | 1.0 | | | | | | | | | | | | | | | | | | 1.0 | |
| | | Water | | Balance | Balance | Balance | Balance | Balance | Balance | Balance | Balance | Balance | Balance | Balance | Balance | Balance | Balance | Balance | Balance | Balance | Balance | Balance | Balance |
| | | Total | | 100 | 100 | 100 | 100 | 100 | 100 | 100 | 100 | 100 | 100 | 100 | 100 | 100 | 100 | 100 | 100 | 100 | 100 | 100 | 100 |
| | pH(20° C.) | | | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 |
| | (b)/(a) (mass ratio) | | | 1.6 | 1.6 | 1.6 | 1.6 | 1.6 | 1.6 | 1.6 | 4.9 | 2.7 | 0.95 | 0.64 | 2.1 | 1.3 | 1.0 | 1.6 | 1.6 | 1.6 | 1.6 | — | 1.6 |
| | (a) + (b) (% by mass) | | | 41.0 | 41.0 | 41.0 | 41.0 | 41.0 | 41.0 | 41.0 | 41.0 | 41.0 | 41.0 | 41.0 | 37.0 | 44.2 | 49.0 | 41.0 | 41.0 | 41.0 | 41.0 | 25.0 | 41.0 |
| | (a)/(c) (mass ratio) | | | 0.64 | 0.80 | 0.94 | 1.6 | 1.6 | 1.6 | 1.6 | 0.41 | 0.65 | 1.2 | 1.5 | 0.71 | 1.1 | 1.4 | 0.94 | 0.94 | 0.94 | 0.94 | 0.0 | 5.3 |
| | (b)/[(a) + (d)] (mass ratio) | | | 0.86 | 0.86 | 0.86 | 0.86 | 0.86 | 0.86 | 0.86 | 1.70 | 1.25 | 0.59 | 0.42 | 0.86 | 0.86 | 0.86 | 1.56 | 1.1 | 0.69 | 0.54 | 0.86 | 0.86 |
| | (c)/[(a) + (b)] (mass ratio) | | | 0.61 | 0.49 | 0.41 | 0.24 | 0.24 | 0.24 | 0.24 | 0.41 | 0.41 | 0.41 | 0.41 | 0.46 | 0.38 | 0.35 | 0.41 | 0.41 | 0.41 | 0.41 | 0.7 | 0.07317 |
| Detergency | | Relative washing value (2) | | +45 | +45 | +45 | +45 | +40 | +45 | +45 | +45 | +45 | +45 | +48 | +43 | +47 | +49 | +45 | +45 | +45 | +45 | Reference (40) | +30 |
| Washing speed | | Relative washing value of 5 min/10 min (2) | | 0.95 | 0.95 | 0.95 | 0.95 | 0.98 | 0.95 | 0.88 | 0.95 | 0.95 | 0.90 | 0.83 | 0.95 | 0.95 | 0.95 | 0.95 | 0.95 | 0.95 | 0.90 | 0.78 | 0.40 |
| | | Washed rate after 5 minutes (2) | | 42 | 42 | 42 | 42 | 42 | 42 | 42 | 45 | 44 | 41 | 38 | 42 | 38 | 38 | 35 | 38 | 43 | 45 | 30 | 14 |

*1 The amount of the portion incorporated from the component (b) is also included.

Examples 1-28 to 1-30 and Comparative Examples 1-8 to 1-10

The liquid detergent compositions for clothing presented in Table 3 were prepared in the same manner as in Example 1-1 and the like by mixing the components presented in Table 3, and the detergency was evaluated by the following "Washing evaluation method (3)". The results are presented in Table 3.

<Washing Evaluation Method (3)>

(3-1) Washed Rate (%) of Sebum Stains

The washed rate (average value) for the 5 minutes of washing time was measured when the bath ratio was set to 12 in "(2-2) Evaluation on washing speed (2)" described in Example 1-10 and the like and represented as the "washed rate after 5 minutes (3)" in Table.

TABLE 3

| | | | | Examples | | | Comparative examples | | |
|---|---|---|---|---|---|---|---|---|---|
| | | | | 1-28 | 1-29 | 1-30 | 1-8 | 1-9 | 1-10 |
| Liquid detergent composition for clothing | Blending amount (% by mass) | (a) | (a-1) | 30.0 | 40.0 | 20.0 | 50.0 | | 40.0 |
| | | (b) | (b-4) | 30.0 | 20.0 | 30.0 | 10.0 | 20.0 | |
| | | (b ') | (b '-1) | | | | | | 20.0 |
| | | (c) | (c-1) | 16.0 | 16.0 | 16.0 | 16.0 | 16.0 | 16.0 |
| | | (d) | (d-1) | | | 10.0 | | 40.0 | |
| | | (e) | (e-2) | 3.2 | 3.2 | 3.2 | 3.2 | 3.2 | 3.2 |
| | | (f) | (f-1) | Amount required to adjust pH to 8.5*1 | | | | | |
| | | Water | | Balance | Balance | Balance | Balance | Balance | Balance |
| | | Total | | 100 | 100 | 100 | 100 | 100 | 100 |
| | pH(20° C.) | | | 8.5 | 8.5 | 8.5 | 8.5 | 8.5 | 8.5 |
| | (b)/(a) (mass ratio) | | | 1.0 | 0.50 | 1.5 | 0.20 | — | — |
| | (a) + (b) (% by mass) | | | 60.0 | 60.0 | 50.0 | 60.0 | 20.0 | 40.0 |
| | (a)/(c) (mass ratio) | | | 1.9 | 2.5 | 1.3 | 3.1 | — | 2.5 |
| | (b)/[(a) + (d)] (mass ratio) | | | 1.0 | 0.50 | 1.0 | 0.20 | 0.50 | — |
| | (c)/[(a) + (b)] (mass ratio) | | | 0.27 | 0.27 | 0.32 | 0.27 | 0.80 | 0.4 |
| Washed rate after 5 minutes (3) | | | | 37 | 35 | 41 | 15 | 26 | 25 |

*1 The amount of the portion incorporated from the component (b) is also included.

Example 1-28 in Table 3 and Example 1-1 in Table 1, Example 1-29 in Table 3 and Example 1-2 in Table 1, or Example 1-30 in Table 3 and Example 1-3 in Table 1 are different from each other only in the bath ratio. The washed rate for the 5 minutes of washing time is substantially equivalent and favorable detergency is exhibited although the bath ratio decreases. On the other hand, when comparison on the washed rate for 5 minutes of washing time is made between Comparative Example 1-8 in Table 3 and Comparative Example 1-1 in Table 1; Comparative Example 1-9 in Table 3 and Comparative Example 1-3 in Table 1; and Comparative example 1-10 in Table 3 and Comparative Example 1-5 in Table 1, it has been found that a decrease in the washed rate is greater in Comparative Examples 1-8 to 1-10 in which washing was performed at a low bath ratio of 12 than the cases where washing was performed at a bath ratio of 20.

Examples 1-31 to 1-39

The liquid detergent compositions were prepared using a variety of anionic surfactants having different p1 and q1 in Formula (2-1) as the component (b), and the evaluation on washing speed (2) was performed by the washing evaluation method (2) described in Example 1-10 and the like. The results are presented in Table 4. Incidentally, components (b) used in the present Examples are as follow.

(b-5): an anionic surfactant produced by the same raw materials and the same production method as the production method (b4) described above and a compound represented by Formula (2-1) in which an average PO added mole number p1 is 1.0 and an average EO added mole number q1 is 1.0. The blending amount in Table is the blending amount of the acid form corresponding to the component (b) and monoethanolamine (the total amount used in this production method) of the counter salt was counted in the component (f).

(b-6): an anionic surfactant produced by the same raw materials and the same production method as the production method (b4) described above and a compound represented by Formula (2-1) in which an average PO added mole number p1 is 1.0 and an average EO added mole number q1 is 3.0. The blending amount in Table is the blending amount of the acid form corresponding to the component (b) and monoethanolamine (the total amount used in this production method) of the counter salt was counted in the component (f).

(b-7): an anionic surfactant produced by the same raw materials and the same production method as the production method (b4) described above and a compound represented by Formula (2-1) in which an average PO added mole number p1 is 2.0 and an average EO added mole number q1 is 1.0. The blending amount in Table is the blending amount of the acid form corresponding to the component (b) and monoethanolamine (the total amount used in this production method) of the counter salt was counted in the component (f).

(b-8): an anionic surfactant produced by the same raw materials and the same production method as the production method (b4) described above and a compound represented by Formula (2-1) in which an average PO added mole number p1 is 2.0 and an average EO added mole number q1 is 3.0. The blending amount in Table is the blending amount of the acid form corresponding to the component (b) and monoethanolamine (the total amount used in this production method) of the counter salt was counted in the component (f).

(b-9): an anionic surfactant produced by the same raw materials and the same production method as the production method (b4) described above and a compound represented by Formula (2-1) in which an average PO added mole number p1 is 3.0 and an average EO added mole number q1 is 1.0. The blending amount in Table is the blending amount of the acid form corresponding to the component (b) and monoethanolamine (the total amount used in this production method) of the counter salt was counted in the component (f).

(b-10): an anionic surfactant produced by the same raw materials and the same production method as the production method (b4) described above and a compound represented by Formula (2-1) in which an average PO added mole number p1 is 3.0 and an average EO added mole number q1 is 2.0. The blending amount in Table is the blending amount of the acid form corresponding to the component (b) and monoethanolamine (the total amount used in this production method) of the counter salt was counted in the component (f).

(b-11): an anionic surfactant produced by the same raw materials and the same production method as the production method (b4) described above and a compound represented by Formula (2-1) in which an average PO added mole number p1 is 3.0 and an average EO added mole number q1 is 3.0. The blending amount in Table is the blending amount of the acid form corresponding to the component (b) and monoethanolamine (the total amount used in this production method) of the counter salt was counted in the component (f).

Blending Examples 1-1 to 1-16

The liquid detergent compositions for clothing presented in Tables 5 and 6 were prepared using a variety of anionic surfactants having different p1 and q1 in Formula (2-1) as the component (b). Incidentally, components (b) used in the present Examples are as follow. Blending Examples 1-1 to 1-16 are considered to exhibit the effect of the invention.

(b-12): an anionic surfactant produced by the same raw materials and the same production method as the production method (b4) described above and a compound represented by Formula (2-1) in which an average PO added mole number p1 is 4.0 and an average EO added mole number q1 is 1.0. The blending amount in Table is the blending amount of the acid form corresponding to the component (b) and monoethanolamine (the total amount used in this production method) of the counter salt was counted in the component (f).

(b-13): an anionic surfactant produced by the same raw materials and the same production method as the production method (b4) described above and a compound represented by Formula (2-1) in which an average PO added mole number p1 is 4.0 and an average EO added mole number q1 is 2.0. The blending amount in Table is the blending amount of the acid form corresponding to the component (b) and monoethanolamine (the total amount used in this production method) of the counter salt was counted in the component (f).

TABLE 4

| | | | | Examples | | | | | | | | |
|---|---|---|---|---|---|---|---|---|---|---|---|---|
| | | | | 1-31 | 1-32 | 1-33 | 1-34 | 1-35 | 1-36 | 1-37 | 1-38 | 1-39 |
| Liquid detergent composition for clothing | Blending amount (% by mass) | (a) | (a-1) | 10.0 | 10.0 | 10.0 | 10.0 | 10.0 | 10.0 | 10.0 | 10.0 | 10.0 |
| | | | (a-2) | 3.0 | 3.0 | 3.0 | 3.0 | 3.0 | 3.0 | 3.0 | 3.0 | 3.0 |
| | | | (a-3) | 3.0 | 3.0 | 3.0 | 3.0 | 3.0 | 3.0 | 3.0 | 3.0 | 3.0 |
| | | (b) | (b-5) | 25.0 | | | | | | | | |
| | | | (b-3) | | 25.0 | | | | | | | |
| | | | (b-6) | | | 25.0 | | | | | | |
| | | | (b-7) | | | | 25.0 | | | | | |
| | | | (b-4) | | | | | 25.0 | | | | |
| | | | (b-8) | | | | | | 25.0 | | | |
| | | | (b-9) | | | | | | | 25.0 | | |
| | | | (b-10) | | | | | | | | 25.0 | |
| | | | (b-11) | | | | | | | | | 25.0 |
| | | (c) | (c-1) | 16.0 | 16.0 | 16.0 | 16.0 | 16.0 | 16.0 | 16.0 | 16.0 | 16.0 |
| | | | (c-2) | 1.0 | 1.0 | 1.0 | 1.0 | 1.0 | 1.0 | 1.0 | 1.0 | 1.0 |
| | | (d) | (d-1) | 13.0 | 13.0 | 13.0 | 13.0 | 13.0 | 13.0 | 13.0 | 13.0 | 13.0 |
| | | (e) | (e-2) | 3.2 | 3.2 | 3.2 | 3.2 | 3.2 | 3.2 | 3.2 | 3.2 | 3.2 |
| | | (f) | (f-1) | Amount required to adjust pH to 7.2*1 | | | | | | | | |
| | | Water | | Balance | Balance | Balance | Balance | Balance | Balance | Balance | Balance | Balance |
| | | Total | | 100 | 100 | 100 | 100 | 100 | 100 | 100 | 100 | 100 |
| | | pH(20° C.) | | 7.2 | 7.2 | 7.2 | 7.2 | 7.2 | 7.2 | 7.2 | 7.2 | 7.2 |
| | | (b)/(a) (mass ratio) | | 1.6 | 1.6 | 1.6 | 1.6 | 1.6 | 1.6 | 1.6 | 1.6 | 1.6 |
| | | (a) + (b) (% by mass) | | 41.0 | 41.0 | 41.0 | 41.0 | 41.0 | 41.0 | 41.0 | 41.0 | 41.0 |
| | | (a)/(c) (mass ratio) | | 0.9 | 0.9 | 0.9 | 0.9 | 0.9 | 0.9 | 0.9 | 0.9 | 0.9 |
| | | (c)/[(a) + (b)] (mass ratio) | | 0.41 | 0.41 | 0.41 | 0.41 | 0.41 | 0.41 | 0.41 | 0.41 | 0.41 |
| | | (a) + (b) + (c) (% by mass) | | 58.0 | 58.0 | 58.0 | 58.0 | 58.0 | 58.0 | 58.0 | 58.0 | 58.0 |
| | | (a) + (d) (% by mass) | | 29.0 | 29.0 | 29.0 | 29.0 | 29.0 | 29.0 | 29.0 | 29.0 | 29.0 |
| | | (a)/(d) (mass ratio) | | 1.2 | 1.2 | 1.2 | 1.2 | 1.2 | 1.2 | 1.2 | 1.2 | 1.2 |
| | | (a) + (b) + (d) (% by mass) | | 54.0 | 54.0 | 54.0 | 54.0 | 54.0 | 54.0 | 54.0 | 54.0 | 54.0 |
| | | (b)/[(a) + (d)] (mass ratio) | | 0.86 | 0.86 | 0.86 | 0.86 | 0.86 | 0.86 | 0.86 | 0.86 | 0.86 |
| | | (c)/[(a) + (b) + (d)] (mass ratio) | | 0.31 | 0.31 | 0.31 | 0.31 | 0.31 | 0.31 | 0.31 | 0.31 | 0.31 |
| | | (a) + (b) + (c) + (d) (% by mass) | | 71.0 | 71.0 | 71.0 | 71.0 | 71.0 | 71.0 | 71.0 | 71.0 | 71.0 |
| Washing speed | | Relative washing value of 5 minutes/10 minutes (2) | | 0.96 | 0.96 | 0.96 | 0.95 | 0.95 | 0.95 | 0.90 | 0.90 | 0.90 |
| | | Washing rate after 5 minutes (2) | | 35 | 35 | 36 | 37 | 38 | 39 | 40 | 41 | 42 |

*1the amount of the portion incorporated from the component (b) is also included.

(b-14): an anionic surfactant produced by the same raw materials and the same production method as the production method (b4) described above and a compound represented by Formula (2-1) in which an average PO added mole number p1 is 4.0 and an average EO added mole number q1 is 3.0. The blending amount in Table is the blending amount of the acid form corresponding to the component (b) and monoethanolamine (the total amount used in this production method) of the counter salt was counted in the component (f).

(b-15): an anionic surfactant produced by the same raw materials and the same production method as the production method (b4) described above and a compound represented by Formula (2-1) in which an average PO added mole number p1 is 4.0 and an average EO added mole number q1 is 4.0. The blending amount in Table is the blending amount of the acid form corresponding to the component (b) and monoethanolamine (the total amount used in this production method) of the counter salt was counted in the component (f).

(b-16): an anionic surfactant produced by the same raw materials and the same production method as the production method (b4) described above and a compound represented by Formula (2-1) in which an average PO added mole number p1 is 4.0 and an average EO added mole number q1 is 5.0. The blending amount in Table is the blending amount of the acid form corresponding to the component (b) and monoethanolamine (the total amount used in this production method) of the counter salt was counted in the component (f).

(b-17): an anionic surfactant produced by the same raw materials and the same production method as the production method (b4) described above and a compound represented by Formula (2-1) in which an average PO added mole number p1 is 5.0 and an average EO added mole number q1 is 1.0. The blending amount in Table is the blending amount of the acid form corresponding to the component (b) and monoethanolamine (the total amount used in this production method) of the counter salt was counted in the component (f).

(b-18): an anionic surfactant produced by the same raw materials and the same production method as the production method (b4) described above and a compound represented by Formula (2-1) in which an average PO added mole number p1 is 5.0 and an average EO added mole number q1 is 2.0. The blending amount in Table is the blending amount of the acid form corresponding to the component (b) and monoethanolamine (the total amount used in this production method) of the counter salt was counted in the component (f).

(b-19): an anionic surfactant produced by the same raw materials and the same production method as the production method (b4) described above and a compound represented by Formula (2-1) in which an average PO added mole number p1 is 5.0 and an average EO added mole number q1 is 3.0. The blending amount in Table is the blending amount of the acid form corresponding to the component (b) and monoethanolamine (the total amount used in this production method) of the counter salt was counted in the component (f).

(b-20): an anionic surfactant produced by the same raw materials and the same production method as the production method (b4) described above and a compound represented by Formula (2-1) in which an average PO added mole number p1 is 5.0 and an average EO added mole number q1 is 4.0. The blending amount in Table is the blending amount of the acid form corresponding to the component (b) and monoethanolamine (the total amount used in this production method) of the counter salt was counted in the component (f).

(b-21): an anionic surfactant produced by the same raw materials and the same production method as the production method (b4) described above and a compound represented by Formula (2-1) in which an average PO added mole number p1 is 5.0 and an average EO added mole number q1 is 5.0. The blending amount in Table is the blending amount of the acid form corresponding to the component (b) and monoethanolamine (the total amount used in this production method) of the counter salt was counted in the component (f).

(b-22): an anionic surfactant produced by the same raw materials and the same production method as the production method (b4) described above and a compound represented by Formula (2-1) in which an average PO added mole number p1 is 1.0 and an average EO added mole number q1 is 4.0. The blending amount in Table is the blending amount of the acid form corresponding to the component (b) and monoethanolamine (the total amount used in this production method) of the counter salt was counted in the component (f).

(b-23): an anionic surfactant produced by the same raw materials and the same production method as the production method (b4) described above and a compound represented by Formula (2-1) in which an average PO added mole number p1 is 1.0 and an average EO added mole number q1 is 5.0. The blending amount in Table is the blending amount of the acid form corresponding to the component (b) and monoethanolamine (the total amount used in this production method) of the counter salt was counted in the component (f).

(b-24): an anionic surfactant produced by the same raw materials and the same production method as the production method (b4) described above and a compound represented by Formula (2-1) in which an average PO added mole number p1 is 2.0 and an average EO added mole number q1 is 4.0. The blending amount in Table is the blending amount of the acid form corresponding to the component (b) and monoethanolamine (the total amount used in this production method) of the counter salt was counted in the component (f).

(b-25): an anionic surfactant produced by the same raw materials and the same production method as the production method (b4) described above and a compound represented by Formula (2-1) in which an average PO added mole number p1 is 2.0 and an average EO added mole number q1 is 5.0. The blending amount in Table is the blending amount of the acid form corresponding to the component (b) and monoethanolamine (the total amount used in this production method) of the counter salt was counted in the component (f).

(b-26): an anionic surfactant produced by the same raw materials and the same production method as the production method (b4) described above and a compound represented by Formula (2-1) in which an average PO added mole number p1 is 3.0 and an average EO added mole number q1 is 4.0. The blending amount in Table is the blending amount of the acid form corresponding to the component (b) and monoethanolamine (the total amount used in this production method) of the counter salt was counted in the component (f).

(b-27): an anionic surfactant produced by the same raw materials and the same production method as the production method (b4) described above and a compound represented by Formula (2-1) in which an average PO added mole number p1 is 3.0 and an average EO added mole number q1 is 5.0. The blending amount in Table is the blending amount of the acid form corresponding to the component (b) and monoethanolamine (the total amount used in this production method) of the counter salt was counted in the component (f).

TABLE 5

| | | | | Blending example | | | | | | | |
|---|---|---|---|---|---|---|---|---|---|---|---|
| | | | | 1-1 | 1-2 | 1-3 | 1-4 | 1-5 | 1-6 | 1-7 | 1-8 |
| Liquid detergent compo-sition for clothing | Blending amount (% by mass) | (a) | (a-1) | 10.0 | 10.0 | 10.0 | 10.0 | 10.0 | 10.0 | 10.0 | 10.0 |
| | | | (a-2) | 3.0 | 3.0 | 3.0 | 3.0 | 3.0 | 3.0 | 3.0 | 3.0 |
| | | | (a-3) | 3.0 | 3.0 | 3.0 | 3.0 | 3.0 | 3.0 | 3.0 | 3.0 |
| | | (b) | (b-12) | 25.0 | | | | | | | |
| | | | (b-13) | | 25.0 | | | | | | |
| | | | (b-14) | | | 25.0 | | | | | |
| | | | (b-15) | | | | 25.0 | | | | |
| | | | (b-16) | | | | | 25.0 | | | |
| | | | (b-17) | | | | | | 25.0 | | |
| | | | (b-18) | | | | | | | 25.0 | |
| | | | (b-19) | | | | | | | | 25.0 |
| | | | (b-20) | | | | | | | | |
| | | | (b-21) | | | | | | | | |
| | | | (b-22) | | | | | | | | |
| | | | (b-23) | | | | | | | | |
| | | | (b-24) | | | | | | | | |
| | | | (b-25) | | | | | | | | |
| | | | (b-26) | | | | | | | | |
| | | | (b-27) | | | | | | | | |
| | | (c) | (c-1) | 16.0 | 16.0 | 16.0 | 16.0 | 16.0 | 16.0 | 16.0 | 16.0 |
| | | | (c-2) | 1.0 | 1.0 | 1.0 | 1.0 | 1.0 | 1.0 | 1.0 | 1.0 |
| | | (d) | (d-1) | 13.0 | 13.0 | 13.0 | 13.0 | 13.0 | 13.0 | 13.0 | 13.0 |
| | | (e) | (e-2) | 3.2 | 3.2 | 3.2 | 3.2 | 3.2 | 3.2 | 3.2 | 3.2 |
| | | (f) | (f-1) | Amount required to adjust pH to 7.2*1 | | | | | | | |
| | | Water | | Balance | Balance | Balance | Balance | Balance | Balance | Balance | Balance |
| | | Total | | 100 | 100 | 100 | 100 | 100 | 100 | 100 | 100 |
| | pH(20° C.) | | | 7.2 | 7.2 | 7.2 | 7.2 | 7.2 | 7.2 | 7.2 | 7.2 |
| | (b)/(a) (mass ratio) | | | 1.6 | 1.6 | 1.6 | 1.6 | 1.6 | 1.6 | 1.6 | 1.6 |
| | (a) + (b) (% by mass) | | | 41.0 | 41.0 | 41.0 | 41.0 | 41.0 | 41.0 | 41.0 | 41.0 |
| | (a)/(c) (mass ratio) | | | 0.9 | 0.9 | 0.9 | 0.9 | 0.9 | 0.9 | 0.9 | 0.9 |
| | (c)/[(a) + (b)] (mass ratio) | | | 0.41 | 0.41 | 0.41 | 0.41 | 0.41 | 0.41 | 0.41 | 0.41 |
| | (a) + (b) + (c) (% by mass) | | | 58.0 | 58.0 | 58.0 | 58.0 | 58.0 | 58.0 | 58.0 | 58.0 |
| | (a) + (d) (% by mass) | | | 29.0 | 29.0 | 29.0 | 29.0 | 29.0 | 29.0 | 29.0 | 29.0 |
| | (a)/(d) (mass ratio) | | | 1.2 | 1.2 | 1.2 | 1.2 | 1.2 | 1.2 | 1.2 | 1.2 |
| | (a) + (b) + (d) (% by mass) | | | 54.0 | 54.0 | 54.0 | 54.0 | 54.0 | 54.0 | 54.0 | 54.0 |
| | (b)/[(a) + (d)] (mass ratio) | | | 0.86 | 0.86 | 0.86 | 0.86 | 0.86 | 0.86 | 0.86 | 0.86 |
| | (c)/[(a) + (b) + (d)] (mass ratio) | | | 0.31 | 0.31 | 0.31 | 0.31 | 0.31 | 0.31 | 0.31 | 0.31 |
| | (a) + (b) + (c) + (d) (% by mass) | | | 71.0 | 71.0 | 71.0 | 71.0 | 71.0 | 71.0 | 71.0 | 71.0 |

TABLE 6

| | | | | Blending examples | | | | | | | |
|---|---|---|---|---|---|---|---|---|---|---|---|
| | | | | 1-9 | 1-10 | 1-11 | 1-12 | 1-13 | 1-14 | 1-15 | 1-16 |
| Liquid detergent compo-sition for clothing | Blending amount (% by mass) | (a) | (a-1) | 10.0 | 10.0 | 10.0 | 10.0 | 10.0 | 10.0 | 10.0 | 10.0 |
| | | | (a-2) | 3.0 | 3.0 | 3.0 | 3.0 | 3.0 | 3.0 | 3.0 | 3.0 |
| | | | (a-3) | 3.0 | 3.0 | 3.0 | 3.0 | 3.0 | 3.0 | 3.0 | 3.0 |
| | | (b) | (b-12) | | | | | | | | |
| | | | (b-13) | | | | | | | | |
| | | | (b-14) | | | | | | | | |
| | | | (b-15) | | | | | | | | |
| | | | (b-16) | | | | | | | | |
| | | | (b-17) | | | | | | | | |
| | | | (b-18) | | | | | | | | |
| | | | (b-19) | | | | | | | | |
| | | | (b-20) | 25.0 | | | | | | | |
| | | | (b-21) | | 25.0 | | | | | | |
| | | | (b-22) | | | 25.0 | | | | | |
| | | | (b-23) | | | | 25.0 | | | | |
| | | | (b-24) | | | | | 25.0 | | | |
| | | | (b-25) | | | | | | 25.0 | | |
| | | | (b-26) | | | | | | | 25.0 | |
| | | | (b-27) | | | | | | | | 25.0 |

TABLE 6-continued

| | | Blending examples | | | | | | | |
|---|---|---|---|---|---|---|---|---|---|
| | | 1-9 | 1-10 | 1-11 | 1-12 | 1-13 | 1-14 | 1-15 | 1-16 |
| (c) | (c-1) | 16.0 | 16.0 | 16.0 | 16.0 | 16.0 | 16.0 | 16.0 | 16.0 |
| | (c-2) | 1.0 | 1.0 | 1.0 | 1.0 | 1.0 | 1.0 | 1.0 | 1.0 |
| (d) | (d-1) | 13.0 | 13.0 | 13.0 | 13.0 | 13.0 | 13.0 | 13.0 | 13.0 |
| (e) | (e-2) | 3.2 | 3.2 | 3.2 | 3.2 | 3.2 | 3.2 | 3.2 | 3.2 |
| (f) | (f-1) | | | | | | | | |
| Water | | Balance | Balance | Balance | Balance | Balance | Balance | Balance | Balance |
| Total | | 100 | 100 | 100 | 100 | 100 | 100 | 100 | 100 |
| pH(20° C.) | | 7.2 | 7.2 | 7.2 | 7.2 | 7.2 | 7.2 | 7.2 | 7.2 |
| (b)/(a) (mass ratio) | | 1.6 | 1.6 | 1.6 | 1.6 | 1.6 | 1.6 | 1.6 | 1.6 |
| (a) + (b) (% by mass) | | 41.0 | 41.0 | 41.0 | 41.0 | 41.0 | 41.0 | 41.0 | 41.0 |
| (a)/(c) (mass ratio) | | 0.9 | 0.9 | 0.9 | 0.9 | 0.9 | 0.9 | 0.9 | 0.9 |
| (c)/[(a) + (b)] (mass ratio) | | 0.41 | 0.41 | 0.41 | 0.41 | 0.41 | 0.41 | 0.41 | 0.41 |
| (a) + (b) + (c) (% by mass) | | 58.0 | 58.0 | 58.0 | 58.0 | 58.0 | 58.0 | 58.0 | 58.0 |
| (a) + (d) (% by mass) | | 29.0 | 29.0 | 29.0 | 29.0 | 29.0 | 29.0 | 29.0 | 29.0 |
| (a)/(d) (mass ratio) | | 1.2 | 1.2 | 1.2 | 1.2 | 1.2 | 1.2 | 1.2 | 1.2 |
| (a) + (b) + (d) (% by mass) | | 54.0 | 54.0 | 54.0 | 54.0 | 54.0 | 54.0 | 54.0 | 54.0 |
| (b)/[(a) + (d)] (mass ratio) | | 0.86 | 0.86 | 0.86 | 0.86 | 0.86 | 0.86 | 0.86 | 0.86 |
| (c)/[(a) + (b) + (d)] (mass ratio) | | 0.31 | 0.31 | 0.31 | 0.31 | 0.31 | 0.31 | 0.31 | 0.31 |
| (a) + (b) + (c) + (d) (% by mass) | | 71.0 | 71.0 | 71.0 | 71.0 | 71.0 | 71.0 | 71.0 | 71.0 |

*1 The amount of the portion incorporated from the component (b) is also included.

Examples 2-1 to 2-6 and Comparative Examples 2-1 to 2-3

The compositions of Examples and Comparative Examples were obtained by mixing the components presented in Table 7.

In a 300-ml glass beaker, a stirrer piece (made of Teflon (registered trademark)) with a diameter of 60 mm was placed and the component (a), the component (b), the component (c) and the required amount of 95% by mass water (water containing sodium hypochlorite at 3 mg/kg) were fed so as to have the obtained mass of 200 g and the blending amounts presented in Table 7. After being fed, the mixture was stirred for 20 minutes at a rotation number of 100 rotation/min. Thereafter, the component (d) and the component (e) were fed therein if necessary, the pH of the composition was adjusted to the pH presented in Table 7 with the component (f), and the mass thereof was adjusted to the finally obtained mass (200 g) using remaining water, thereby obtaining the liquid detergent compositions for clothing presented in Table 7. Incidentally, in Example 2-6, the following other components were added at the time of adding the component (d). The pH was measured by the method described in section 8.3 of JIS K3362: 1998 (temperature of composition at the time of measurement: 20° C.). Each of the compositions thus obtained was subjected to the following respective evaluations. The components in Table are as follows. The results are presented in Table 7. The components in Table are as follows.

Component (a)

(a-1): a compound obtained by adding ethylene oxide to a secondary alcohol having 12 to 14 carbon atoms at 7 moles on average [SOFTANOL 70 (trade name) manufactured by NIPPON SHOKUBAI CO., LTD.]

(a-2): a compound obtained by adding ethylene oxide to a primary alcohol having 12 carbon atoms at 3 moles on average [EMULGEN 103 (trade name) manufactured by Kao Corporation]

(a-3): a compound obtained by adding ethylene oxide to a primary alcohol having 12 carbon atoms at 5 moles on average [EMULGEN 105 (trade name) manufactured by Kao Corporation]

Component (b)

(b2-1): an anionic surfactant produced by the following production method (b2-1) [the blending amount in Table is the blending amount of the acid form corresponding to the component (b) and monoethanolamine (the total amount used in this production method) of the counter salt was counted in the component (f).]

<Production Method (b2-1)>

In an autoclave equipped with a stirring device, a temperature control device and an automatic introduction device, 1107 g of a natural fats and oils-derived primary linear alcohol having 12 and 14 carbon atoms (trade name: KALCOL 2470) and 3.5 g of KOH were fed and subjected to the dehydration for 30 minutes at 110° C. and 1.3 kPa.

After the dehydration, the resultant was subjected to nitrogen substitution, the temperature thereof was raised to 145° C., and then 1107 g of ethylene oxide (hereinafter, referred to as "EO") was fed therein. The mixture was subjected to the addition reaction and aging at 145° C. and then cooled to 80° C., the unreacted EO was removed therefrom at 4.0 kPa. After removing the unreacted EO, the temperature thereof was raised to 120° C., and then 1460 g of propane-1,2-diyl oxide (hereinafter, referred to as "PO") was fed therein. The mixture was subjected to the addition reaction and aging at 120° C., then 3.8 g of acetic acid was added into the autoclave, followed by stirring for 30 minutes at 80° C., and then the extraction thereof was performed, thereby obtaining an alkoxylate having an average EO added mole number of 2.0 and an average PO added mole number of 2.0.

The alkoxylate thus obtained was sulfated by a falling thin-film type reactor using $SO_3$ gas. The sulfated product thus obtained was neutralized with monoethanolamine to obtain a composition containing a polyoxypropan-1,2-diyl alkyl ether sulfate ester salt [(b2-1)].

The results of the gas chromatographic analysis and NMR analysis reveal that (b2-1) thus obtained is a compound represented by Formula (2-2) in which $R^2$ is a linear primary alkyl group having 12 and 14 carbon atoms, $A^1O$ is a propyleneoxy group, p2 is 2.0 on average and q2 is 2.0 on average.

(b2-2): an anionic surfactant produced by the following production method (b2-2) [the blending amount in Table is the blending amount of the acid form corresponding to the component (b) and monoethanolamine (the total amount used in this production method) of the counter salt was counted in the component (f)].

<Production Method (b2-2)>

In an autoclave equipped with a stirring device, a temperature control device and an automatic introduction device, 1107 g of a natural fats and oils-derived primary linear alcohol having 12 and 14 carbon atoms (trade name: KALCOL 2470) and 3.5 g of KOH were fed and subjected to the dehydration for 30 minutes at 110° C. and 1.3 kPa.

After the dehydration, the resultant was subjected to nitrogen substitution, the temperature thereof was raised to 145° C., and then 554 g of EO was fed therein. The mixture was subjected to the addition reaction and aging at 145° C. and then cooled to 80° C., the unreacted EO was removed therefrom at 4.0 kPa. After removing the unreacted EO, the temperature thereof was raised to 120° C., and then 1460 g of PO was fed therein. The mixture was subjected to the addition reaction and aging at 120° C., then 3.8 g of acetic acid was added into the autoclave, followed by stirring for 30 minutes at 80° C., and then the extraction thereof was performed, thereby obtaining an alkoxylate having an average EO added mole number of 1.0 and an average PO added mole number of 2.0.

The alkoxylate thus obtained was sulfated by a falling thin-film type reactor using $SO_3$ gas. The sulfated product thus obtained was neutralized with monoethanolamine to obtain a composition containing a polyoxypropan-1,2-diyl alkyl ether sulfate ester salt [(b2-2)].

The results of the gas chromatographic analysis and NMR analysis reveal that (b2-2) thus obtained is a compound represented by Formula (2-2) in which $R^2$ is a linear primary alkyl group having 12 and 14 carbon atoms, $A^1O$ is a propyleneoxy group, p2 is 2.0 on average and q2 is 1.0 on average.

Component (c)

(c-1): diethylene glycol monobutyl ether (c-2): propylene glycol (c-3): 1,6-hexanediol Component (d)

(d–1): a product obtained by subjecting a coconut oil-derived primary linear alcohol having 10 to 14 carbon atoms to the block addition reaction by 9 moles of ethylene oxide, 2 moles of propylene oxide and 9 moles of ethylene oxide per one mole in this order [a compound represented by Formula $R^3O\text{-}(EO)_{n11}\text{-}(A^2O)_{n12}\text{-}(EO)_{n13}H$ in which $R^3$ is a linear alkyl group having 10 to 14 carbon atoms, $A^2O$ is an oxypropylene group, n11 is 9 on average, n12 is 2 on average and n13 is 9 on average and of which the compound of $R^3$—O-EO is 85 mol % or more and the compound of -EO—H is 90 mol % or more.]

Component (e)

(e-1): LUNAC L-55 (trade name) (coconut oil-based fatty acid; manufactured by Kao Corporation)

Component (f)

(f-1): monoethanolamine (including the blending amount as the counter ion of component (b))

<Other Components>

Polymer (1): a polymer compound synthesized by the method of Synthesis Example 1 described in paragraph 0020 of JP-A 10-60476.

Fluorescent dye: Tinopal CBS-X (trade name) (manufactured by BASF)

Enzyme (1): Everlase 16.0L-EX (trade name) (protease, manufactured by Novozymes)

Enzyme (2): Stainzyme (trade name) (amylase, manufactured by Novozymes)

Dye (1): Green No. 202

Dye (2): Yellow No. 203

[1] Evaluation on Detergency

<Preparation of Stained Cloth for Evaluation>

Preparation of Cloth Artificially Stained with Model Sebum

The cloth artificially stained with model sebum was prepared by attaching an artificial staining liquid of model sebum having the following composition to a cloth. The attachment of the artificial staining liquid of model sebum to the cloth was carried out by printing the artificial staining liquid on the cloth using a gravure roll coater. The process of preparing the cloth artificially stained with model sebum by attaching the artificial staining liquid of model sebum to the cloth was performed at a cell volume of gravure roll of 58 $cm^3/m^2$, a coating speed of 1.0 m/min, a drying temperature of 100° C. and a drying time of 1 minute. Cotton 2003 (manufactured by TANIGASHIRA SHOTEN) was used as the cloth.

*Composition of Artificial Staining Liquid of Model Sebum: 0.4% by mass of lauric acid, 3.1% by mass of myristic acid, 2.3% by mass of pentadecanoic acid, 6.2% by mass of palmitic acid, 0.4% by mass of heptadecanoic acid, 1.6% by mass of stearic acid, 7.8% by mass of oleic acid, 13.0% by mass of triolein, 2.2% by mass of n-hexadecyl palmitate, 6.5% by mass of squalene, 1.9% by mass of egg white lecithin liquid crystal material, 8.1% by mass of Kanuma red soil, 0.01% by mass of carbon black and water as the balance (total 100% by mass)

Preparation of Cloth Stained with Meat Sauce 0.15 g of a commercially available retort meat sauce (manufactured by Ma•Ma Macaroni Co., Ltd.) was applied to the cotton knitted cloth (manufactured by TANIGASHIRA SHOTEN), uniformly spread, dried for 12 hours at room temperature, and then subjected to the test.

<Washing Evaluation Method>

(1) Evaluation on Detergency

Each of the 5 sheets of cloth stained with meat sauce (6 cm×6 cm) thus prepared was directly applied with 67 μL of the liquid detergent composition for evaluation, then allowed to stand for 5 minutes in that state, and placed in 1 L of tap water to be washed using Terg-O-Tometer (Ueshima, MS-8212) at 85 rpm. The washing conditions were as follows. The washing time was 10 minutes, the concentration of the detergent composition at the time of washing was 0.033% by mass, the water temperature was 20° C., and the bath ratio was 20 (adjusted with the cloth obtained by cutting cotton 2003 (manufactured by TANIGASHIRA SHOTEN) into 6 cm×6 cm). After washing, rinsing was performed for 3 minutes with tap water (20° C.)

The reflectivity of the original cloth before staining and the cloth before and after washing at 550 nm was measured by a colorimetric color difference meter (Z-300A manufactured by NIPPON DENSHOKU INDUSTRIES Co., LTD.), and the washed rate (%) was determined by the following Equation (washed rate in Table is the average value of the washed rates of 5 sheets).

$$\text{Washed rate (\%)}=100\times[(\text{reflectivity after washing}-\text{reflectivity before washing})/(\text{reflectivity of original cloth}-\text{reflectivity before washing})$$

The relative washing value was determined by the following Equation while the washed rate (%) (expressed as a numerical value in parentheses in Table) of the composition of the Comparative example 2-1 was used as a reference. The results are presented in Table.

Relative washing value=[washed rate (%) of Example or Comparative Example to be compared]−[washed ratio (%) of Comparative Example 2-1 (reference composition)]

It indicates that detergency is higher as the value of the relative washing value is higher. A significant difference is acknowledged when the difference in the relative washing value is 3 or more.

(2) Evaluation on Washing Speed

The 5 sheets of cloth artificially stained with model sebum (6 cm×6 cm) thus prepared were washed using Terg-O-Tometer (Ueshima, MS-8212) for 5 minutes or 10 minutes at 85 rpm. The washing conditions were as follows. The concentration of the liquid detergent composition was 0.033% by mass, and the water temperature was 20° C. After washing, rinsing was performed for 3 minutes with tap water (20° C.). The washed rate was measured by the method described in (1) above and the average value of the 5 sheets was determined. The relative washing value was determined from each washed rate (average value) for the 5 minutes and 10 minutes of washing time by the following Equation. The results are presented in Table.

Relative washing value of 5 min/10 min (washing speed)=washed rate (%) for 5 minutes of washing time/washed rate (%) for 10 minutes of washing time

The invention claimed is:

1. A liquid detergent composition for clothing formed by blending the following component (a), component (b), component (c) and water, wherein a total of a blending amount of the component (a) and a blending amount of the component (b) is 15% by mass or more and 70% by mass or less with respect to a total mass of the entire blended raw materials, and the mass ratio of the blending amount of the component (b) to the blending amount of the component (a), component (b)/component (a), is 0.5 or more and 7 or less:

component (a): a nonionic surfactant represented by the following Formula (1):

$$R^1O\text{-}(EO)_mH \quad (1)$$

in Formula (1), $R^1$ represents a hydrocarbon group having 8 or more and 18 or less carbon atoms, EO represents an ethyleneoxy group, and m represents an average added mole number and m is a number of 1 or more and 10 or less;

component (b) is an anionic surfactant selected from an anionic surfactant represented by the following Formula (2-1) and an anionic surfactant represented by the following Formula (2-2):

$$R^2O\text{-}(A^1O)_{p1}\text{-}(EO)_{q1}\text{—}SO_3M \quad (2\text{-}1)$$

in Formula (2-1), $R^2$ represents a hydrocarbon group having 8 or more and 22 or less carbon atoms, $A^1O$

TABLE 7

| | | | | Examples | | | | | | Comparative examples | | |
|---|---|---|---|---|---|---|---|---|---|---|---|---|
| | | | | 2-1 | 2-2 | 2-3 | 2-4 | 2-5 | 2-6 | 2-1 | 2-2 | 2-3 |
| Liquid detergent composition for clothing | Blending amount (% by mass) | (a) | (a-1) | 30 | 40 | 15 | 30 | 10 | 10 | 1 | 30 | 50 |
| | | | (a-2) | | | | | | 3 | | | |
| | | | (a-3) | | | | | 10 | 10 | | | |
| | | (b) | (b2-1) | 30 | 20 | 45 | | 30 | 30 | 15 | 30 | 10 |
| | | | (b2-2) | | | | 30 | | | | | |
| | | (c) | (c-1) | 12 | 12 | 12 | 12 | 12 | 12 | 12 | 2 | 12 |
| | | | (c-2) | | | | | | 3 | | | |
| | | (d) | (d-1) | | | | | 10 | 10 | 45 | | |
| | | (e) | (e-1) | 3.0 | 3.2 | 3.2 | 3.2 | 3.2 | 3.2 | 3.2 | 3.2 | 3.2 |
| | | (f) | (f-1) | 4 | 4 | 4 | 4 | 4 | 4 | 4 | 4 | 4 |
| | | | Polymer(1) | | | | | | 3 | | | |
| | | | Fluorescence dye | | | | | | 0.2 | | | |
| | | | Enzyme (1) | | | | | | 0.5 | | | |
| | | | Enzyme (2) | | | | | | 0.3 | | | |
| | | | Dye (1) | | | | | | 0.0005 | | | |
| | | | Dye (2) | | | | | | 0.0003 | | | |
| | | | Perfume | | | | | | 1.0 | | | |
| | | | Water | Balance | Balance | Balance | Balance | Balance | Balance | Balance | Balance | Balance |
| | | | Total | 100 | 100 | 100 | 100 | 100 | 100 | 100 | 100 | 100 |
| | | | pH(20° C.) | 8.5 | 8.5 | 8.5 | 8.5 | 8.5 | 8.5 | 8.5 | 8.5 | 8.5 |
| | | | (b)/(a) (Mass ratio) | 1.0 | 0.50 | 3.0 | 1.0 | 1.5 | 1.3 | 15.0 | 1.0 | 0.20 |
| | | | (b)/[(a) + (d)] (Mass ratio) | 1.0 | 0.50 | 3.0 | 1.0 | 1.0 | 0.91 | 0.33 | 1.0 | 0.20 |
| | | | (c)/[(a) + (b)] (Mass ratio) | 0.20 | 0.20 | 0.20 | 0.20 | 0.24 | 0.28 | 0.75 | 0.033 | 0.20 |
| | | | (a) + (b) (% by mass) | 60.0 | 60.0 | 60.0 | 60.0 | 50.0 | 53.0 | 16.0 | 60.0 | 60.0 |
| | | | (a) + (b) + (c) (% by mass) | 72.0 | 72.0 | 72.0 | 72.0 | 62.0 | 68.0 | 28.0 | 62.0 | 72.0 |
| Relative washing value | | | | +50 | +50 | +47 | +48 | +45 | +46 | 40 (reference) | 0 | +30 |
| Relative washing value of 5 min/10 min | | | | 0.95 | 0.83 | 0.90 | 0.95 | 0.92 | 0.91 | 0.73 | 0.55 | 0.60 |

represents an alkyleneoxy group selected from an alkyleneoxy group having 3 carbon atoms and an alkyleneoxy group having 4 carbon atoms, EO represents an ethyleneoxy group, and p1 and q1 each represent an average added mole number, p1 is a number of 1 or more and 4 or less and q1 is a number of 0 or more and 10 or less; and M represents a cation; and $$R^2O\text{-}(EO)_{q2}\text{-}(A^1O)_{p2}\text{—}SO_3M \quad (2\text{-}2)$$

in Formula (2-2), $R^2$ represents a hydrocarbon group having 8 or more and 22 or less carbon atoms, $A^1O$ represents an alkyleneoxy group selected from an alkyleneoxy group having 3 carbon atoms and an alkyleneoxy group having 4 carbon atoms, EO represents an ethyleneoxy group, and p2 and q2 each represent an average added mole number, p2 is a number of 1 or more and 5 or less and q2 is a number of 0.5 or more and 5 or less; and M represents a cation; and component (c): an organic solvent having one or more hydroxyl groups at 5% by mass or more and 40% by mass or less with respect to the total mass of the entire blended raw materials.

2. The liquid detergent composition for clothing according to claim 1, wherein the component (b) is an anionic surfactant represented by Formula (2-2).

3. The liquid detergent composition for clothing according to claim 1, wherein the component (b) is an anionic surfactant, p1 and p2 in Formula (2-1) and (2-2), respectively, having a number of 1 or more and 3 or less.

4. The liquid detergent composition for clothing according to claim 1, wherein the total of the blending amount of the component (a) and the blending amount of the component (b) is 30% by mass or more and 70% by mass or less with respect to the total mass of the entire blended raw materials.

5. The liquid detergent composition for clothing according to claim 1, wherein the composition has a pH at 20° C. of 6 or more and 11 or less.

6. The liquid detergent composition for clothing according to claim 1, wherein the mass ratio of the blending amount of the component (b) to the blending amount of the component (a), component (b)/component (a), is 0.5 or more and 3 or less.

7. The liquid detergent composition for clothing according to claim 1, wherein the mass ratio of the blending amount of the component (a) to the blending amount of the component (c), component (a)/component (c), is 0.5 or more and 2.5 or less.

8. The liquid detergent composition for clothing according to claim 1, wherein in the component (a), a proportion of a nonionic surfactant (a1) selected from a nonionic surfactant represented by Formula (1) in which $R^1$ is a branched primary hydrocarbon group and a nonionic surfactant represented by Formula (1) in which $R^1$ is a linear secondary hydrocarbon group is 50% by mass or more.

9. The liquid detergent composition for clothing according to claim 1, wherein the component (a) is formed by blending a nonionic surfactant (a1) selected from a nonionic surfactant represented by Formula (1) in which $R^1$ is a branched primary hydrocarbon group and a nonionic surfactant represented by Formula (1) in which $R^1$ is a linear secondary hydrocarbon group and a nonionic surfactant (a2) represented by Formula (1) in which $R^1$ is a linear primary hydrocarbon group.

10. The liquid detergent composition for clothing according to claim 1, the liquid detergent composition being formed by further blending the following component (d), wherein a mass ratio of the blending amount of the component (b) to a total of the blending amount of the component (a) and a blending amount of the component (d), [component (b)/component (a)+component (d)], is 0.4 or more and 3 or less:

component (d): a nonionic surfactant represented by the following Formula (3):

$$R^3O\text{-}(A^2O)_nH \quad (3)$$

in Formula (3), $R^3$ represents a hydrocarbon group having 8 or more and 22 or less carbon atoms, $A^2O$ represents an alkyleneoxy group having 2 or more and 5 or less carbon atoms, and n represents an average added mole number and is a number of 16 or more and 35 or less, and $A^2O$ contains an ethyleneoxy group at 14 moles or more on average, provided that n is a number of 18 or more when all of $A^2O$ are an ethyleneoxy group.

11. The liquid detergent composition for clothing according to claim 1, wherein a blending amount of a cationic surfactant is 5% by mass or less.

12. A method for washing clothing comprising:

washing clothing with a washing liquid containing water and the liquid detergent composition for clothing according to claim 1 at 0.01% by mass or more and 0.1% by mass or less and having a temperature of 0° C. or higher and 35° C. or lower for 1 minute or longer and 7 minutes or shorter under a condition in which a bath ratio expressed by a ratio of an amount of the washing liquid (L) to a mass of clothing, an amount of washing liquid (L)/a mass of clothing (kg), is 3 or more and 50 or less.

13. The method for washing clothing according to claim 12, wherein clothing is washed for 3 minutes or longer and 7 minutes or shorter.

14. The method for washing clothing according to claim 12, wherein the bath ratio expressed by a ratio of an amount of the washing liquid (L) to a mass of clothing, an amount of washing liquid (L)/a mass of clothing (kg), is 5 or more and 20 or less.

15. The method for washing clothing according to claim 12, wherein the liquid detergent composition for clothing is contained in the washing liquid at 0.02% by mass or more and 0.1% by mass or less.

16. The method for washing clothing according to claim 12, wherein the washing of clothing is performed using a rotary washing machine.

17. The method for washing clothing according to claim 16, wherein the rotary washing machine is a drum fully automatic washing machine, a pulsator fully automatic washing machine or an agitator fully automatic washing machine.

* * * * *